US011702305B2

(12) United States Patent
Kuroda et al.

(10) Patent No.: US 11,702,305 B2
(45) Date of Patent: Jul. 18, 2023

(54) SHEET FEEDING DEVICE AND IMAGE FORMING APPARATUS

(71) Applicant: SHARP KABUSHIKI KAISHA, Sakai (JP)

(72) Inventors: Kenji Kuroda, Osaka (JP); Hironori Ogasawara, Osaka (JP); Yasumasa Morimoto, Osaka (JP); Toshiki Fukunishi, Osaka (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 199 days.

(21) Appl. No.: 17/136,459

(22) Filed: Dec. 29, 2020

(65) Prior Publication Data

US 2021/0221633 A1 Jul. 22, 2021

(30) Foreign Application Priority Data

Jan. 22, 2020 (JP) ..... 2020-008516

(51) Int. Cl.
*B65H 3/06* (2006.01)

(52) U.S. Cl.
CPC ..... *B65H 3/0684* (2013.01); *B65H 3/0669* (2013.01)

(58) Field of Classification Search
CPC ..... B65H 3/0684; B65H 3/0669
See application file for complete search history.

(56) References Cited

U.S. PATENT DOCUMENTS

2005/0184449 A1* 8/2005 Morimoto ..... B65H 3/0669 271/118
2021/0130119 A1* 5/2021 Migita ..... B65H 3/0684

FOREIGN PATENT DOCUMENTS

JP 2001-220026 A 8/2001

* cited by examiner

*Primary Examiner* — Howard J Sanders
(74) *Attorney, Agent, or Firm* — ScienBiziP, P.C.

(57) ABSTRACT

A sheet feeding device includes a pickup roller, a lifting/lowering mechanism, and a driver device. The lifting/lowering mechanism includes a restricting member that releasably restricts the pickup roller from being lowered from a lifted position of the pickup roller at the lifted position. In the sheet feeding device, the driver device drives the lifting/lowering mechanism so that the pickup roller is lowered from the lifted position of the pickup roller, and a drive suspend operation is performed in which the driving of the lifting/lowering mechanism by driver device is suspended after a predetermined time during which the pickup roller does not contact a sheet loading tray or a sheet on the sheet loading tray elapses from a time point when the pickup roller is released from being restricted by the restricting member at the lifted position.

7 Claims, 24 Drawing Sheets

SHEET FEEDING DEVICE AND IMAGE FORMING APPARATUS

BACKGROUND OF THE INVENTION

Field of the Invention

The present invention relates to a sheet feeding device and an image forming apparatus such as a copying machine, a multifunction peripheral, and a printer.

Description of the Background Art

Some sheet feeding devices include, for example, a pickup roller, a lifting/lowering mechanism, and a driver device. The pickup roller picks up sheets (documents or recording sheet) loaded on a sheet loading tray. The lifting/lowering mechanism lifts and lowers the pickup roller. The driver device drives the lifting/lowering mechanism. The sheet feeding device lowers the pickup roller from a lifted position to pick up a sheet loaded on the sheet loading tray.

In such a sheet feeding device, in general, there is a backlash (a play or a rattle) in a drive transmission system (particularly, the lifting/lowering mechanism) in which a rotational driving force is transmitted from the driver device to the pickup roller, and the pickup roller may fall by its own weight by an amount of the backlash when the pickup roller is lowered. As a result, the rotational driving force from the driver device has a momentum amplified resulting from its own weight falling by the amount of the backlash, and a loud collision noise is generated when the pickup roller contacts the sheet loading tray or a sheet on the sheet loading tray.

In this regard, Japanese Unexamined Patent Application Publication No. 2001-220026 (hereinafter, referred to as Patent Document 1) discloses a sheet feeding device that restricts a feeding member (pickup roller) from lowering during the lowering and reduces a lowering speed of the feeding member subjected to the restriction.

However, the sheet feeding device described in Patent Document 1 performs control to reduce the lowering speed of the feeding member, and thus, a control configuration for lowering the feeding member is complicated.

Therefore, an object of the present invention is to provide a sheet feeding device and an image forming apparatus capable of suppressing a collision noise generated when a pickup roller contacts a sheet loading tray or a sheet on the sheet loading tray, and further providing a simplified control configuration for lowering the pickup roller.

SUMMARY OF THE INVENTION

In order to solve the above-mentioned problem, a sheet feeding device according to the present invention includes a pickup roller that picks up a sheet loaded on a sheet loading tray, a lifting/lowering mechanism that lifts and lowers the pickup roller, and a driver device that drives the lifting/lowering mechanism, where the pickup roller is lowered from a lifted position in picking up the sheet on the sheet loading tray. The lifting/lowering mechanism includes a restricting member that releasably restricts the pickup roller from being lowered from the lifted position at the lifted position of the pickup roller, and the driver device drives the lifting/lowering mechanism so that the pickup roller is lowered from the lifted position of the pickup roller, and a drive suspend operation in which driving of the lifting/lowering mechanism by the driver device is suspended is performed after a predetermined time during which the pickup roller does not contact the sheet loading tray or the sheet on the sheet loading tray elapses from a time point when the pickup roller is released from being restricted by the restricting member at the lifted position of the pickup roller.

An image forming apparatus according to the present invention includes a sheet feeding device according to the present invention.

According to the present invention, it is possible to suppress a collision noise generated when a pickup roller contacts a sheet loading tray or a sheet on the sheet loading tray, and further provide a simplified control configuration for lowering the pickup roller.

DESCRIPTION OF THE PREFERRED EMBODIMENTS

Figure 1:
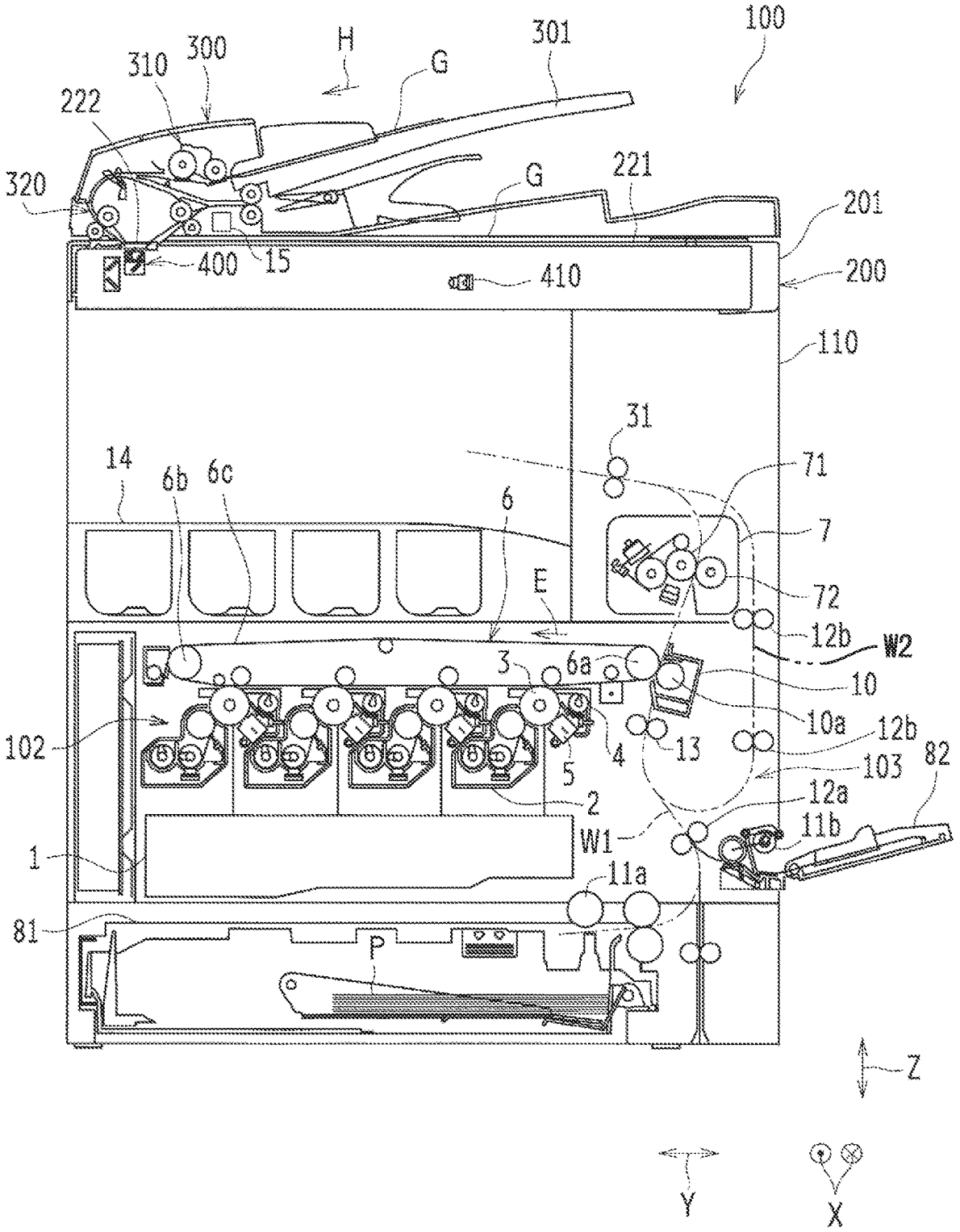
FIG. 1 is a schematic cross-sectional view of an image forming apparatus including an image reading device according to the present embodiment as viewed from a front.

An embodiment according to the present invention will be described below with reference to the drawings. In the following description, same parts are denoted by the same reference numerals. The names and functions of the same parts are also the same. Therefore, detailed description thereof will not be repeated.

Image Forming Apparatus

FIG. 1 is a schematic cross-sectional view of an image forming apparatus 100 including an image reading device 200 according to the present embodiment as viewed from a front. In FIG. 1, reference numeral X represents a width direction, reference numeral Y represents a left-right direction, reference numeral Z represents an up-down direction (vertical direction), and reference numeral H represents a conveyance direction of a document G (that is an example of a sheet), respectively.

The image forming apparatus 100 according to the present embodiment is a color image forming apparatus for forming multicolor and monochromatic images on sheet P. The image forming apparatus 100 performs an image forming process based on image data read by the image reading device 200 or image data transmitted from outside. The image forming apparatus 100 may be a monochrome image forming apparatus.

The image forming apparatus 100 includes a document feeding device (a sheet feeding device 300) and an image forming apparatus main body 110. The image forming apparatus main body 110 is provided with an image former 102 and a sheet transport system 103.

The image former 102 includes an exposure unit 1, a development unit 2, a photoconductive drum 3 acting as an electrostatic latent image carrier, a cleaner 4, a charging device 5, a primary transfer device 6, and a fixing unit 7. The sheet transport system 103 includes a paper feed tray 81, a manual paper feed tray 82, a discharge roller 31, and a discharge tray 14.

At an upper part of the image forming apparatus main body 110, the image reading device 200 that reads an image of the document G is provided. The image reading device 200 includes a document platen 221 (specifically, a document placement glass) on which the document G is placed, and a document reading plate 222 (specifically, a document reading glass). The sheet feeding device 300 is provided above the document platen 221 and the document reading plate 222. In the image forming apparatus 100, the image of the document G read by the image reading device 200 is sent, as image data, to the image forming apparatus main body 110 and the image is recorded on the sheet P.

The image forming apparatus main body 110 is provided with a sheet conveyance path W1. The paper feed tray 81 or the manual paper feed tray 82 supplies the sheet P to the sheet conveyance path W1. The sheet conveyance path W1 guides the sheet P to the discharge tray 14 via a transfer roller 10*a* and the fixing unit 7. The fixing unit 7 heats and fixes, onto the sheet P, a toner image formed on the sheet P. In the vicinity of the sheet conveyance path W1, pickup rollers 11*a* and 11*b*, a convey roller 12*a*, a paper stop roller 13, the transfer roller 10*a* in a secondary transfer device 10, a heat roller 71 and a pressure roller 72 in the fixing unit 7, and the discharge roller 31 are arranged.

In the image forming apparatus 100, in forming an image, the surface of the photoconductive drum 3 uniformly charged by the charging device 5 is exposed with laser by the exposure unit 1 according to image data (image information), so that an electrostatic latent image is each formed on the photoconductive drum 3. The electrostatic latent image formed on the photoconductive drum 3 is developed by the development unit 2 and visualized as a toner image. The toner image on the photoconductive drum 3 is transferred on an intermediate transfer belt 6*c* stretched on a driving roller 6*a* and a driven roller 6*b* in the primary transfer device 6. The toner image on the intermediate transfer belt 6*c* rotated in a predetermined rotation direction E is conveyed to a secondary transfer device 10. The sheet P supplied by the paper feed tray 81 or the manual paper feed tray 82 is conveyed to the paper stop roller 13 via the convey roller 12*a*. Next, the sheet P is conveyed to the transfer roller 10*a* by the paper stop roller 13 at a timing of matching the sheet P with the toner image on the photoconductive drum 3. The toner image on the photoconductive drum 3 is transferred onto the sheet P by the transfer roller 10*a*. After that, the sheet P passes through the heat roller 71 and the pressure roller 72 in the fixing unit 7, and is discharged onto the discharge tray 14 via the discharge roller 31. If an image is formed not only on a front side of the sheet P but also on a back side, the sheet P is conveyed in a reverse direction from the discharge roller 31 to a reversal sheet conveyance path W2. The front and back sides of the sheet P are reversed via reversal conveyance rollers 12*b* to 12*b*, and the sheet P is guided again to the paper stop roller 13. Next, the sheet P is discharged toward the discharge tray 14 after the toner image is formed and fixed on the back side in much the same way as on the front side.

Image Reading Device

The image reading device 200 includes an image reader 400 (specifically, an image reading unit) that scans the document G and reads the image of the document G. The image reading device 200 scans the document G placed on the document platen 221 while moving the image reader 400 to one side of the document G in the left-right direction Y along the lower surface of the document platen 221. Thus, the image reading device 200 reads the image of the document G placed on the document platen 221 with a reduction type image sensor 410. The image reading device 200 stops the image reader 400 at a position below the document reading plate 222, and scans the document G which is conveyed by the document feeding device (sheet feeding device 300) and passes over the document reading plate 222. Thus, the image reading device 200 reads, with the reduction type image sensor 410, the image of the document G conveyed by the sheet feeding device 300.

The image reader 400 is provided below the document platen 221 and the document reading plate 222 to be reciprocally movable in the left-right direction Y with respect to a housing 201 of the image reading device 200. The image reader 400 is driven by a driver device (drive motor) (not illustrated).

Sheet Feeding Device

Figure 2:
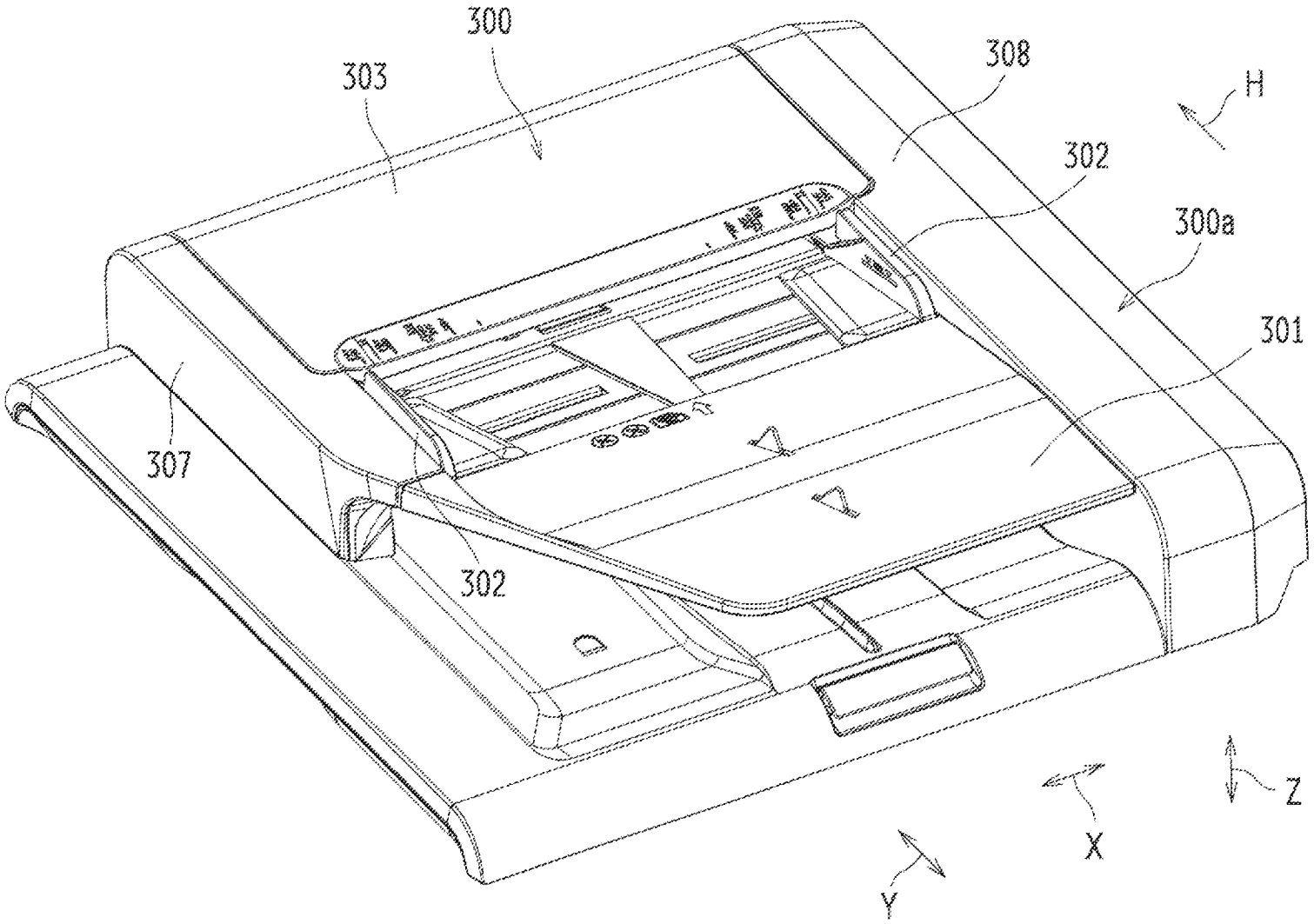
FIG. 2 is a perspective view illustrating a sheet feeding device illustrated in FIG. 1.
Figure 3:
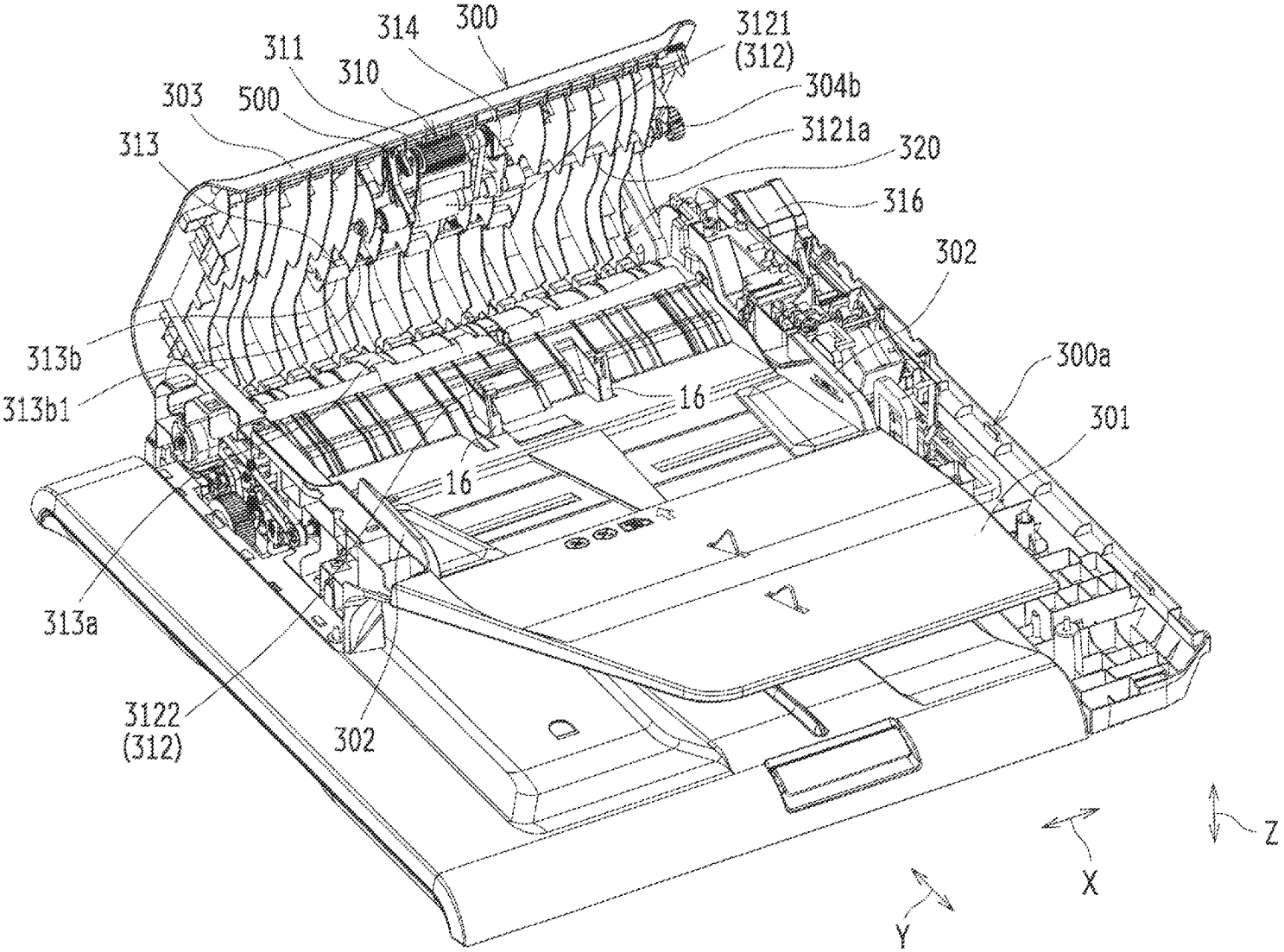
FIG. 3 is a perspective view illustrating a state where front and rear exterior covers of the sheet feeding device illustrated in FIG. 1 are removed and a sheet conveyance roller is exposed.
Figure 4:
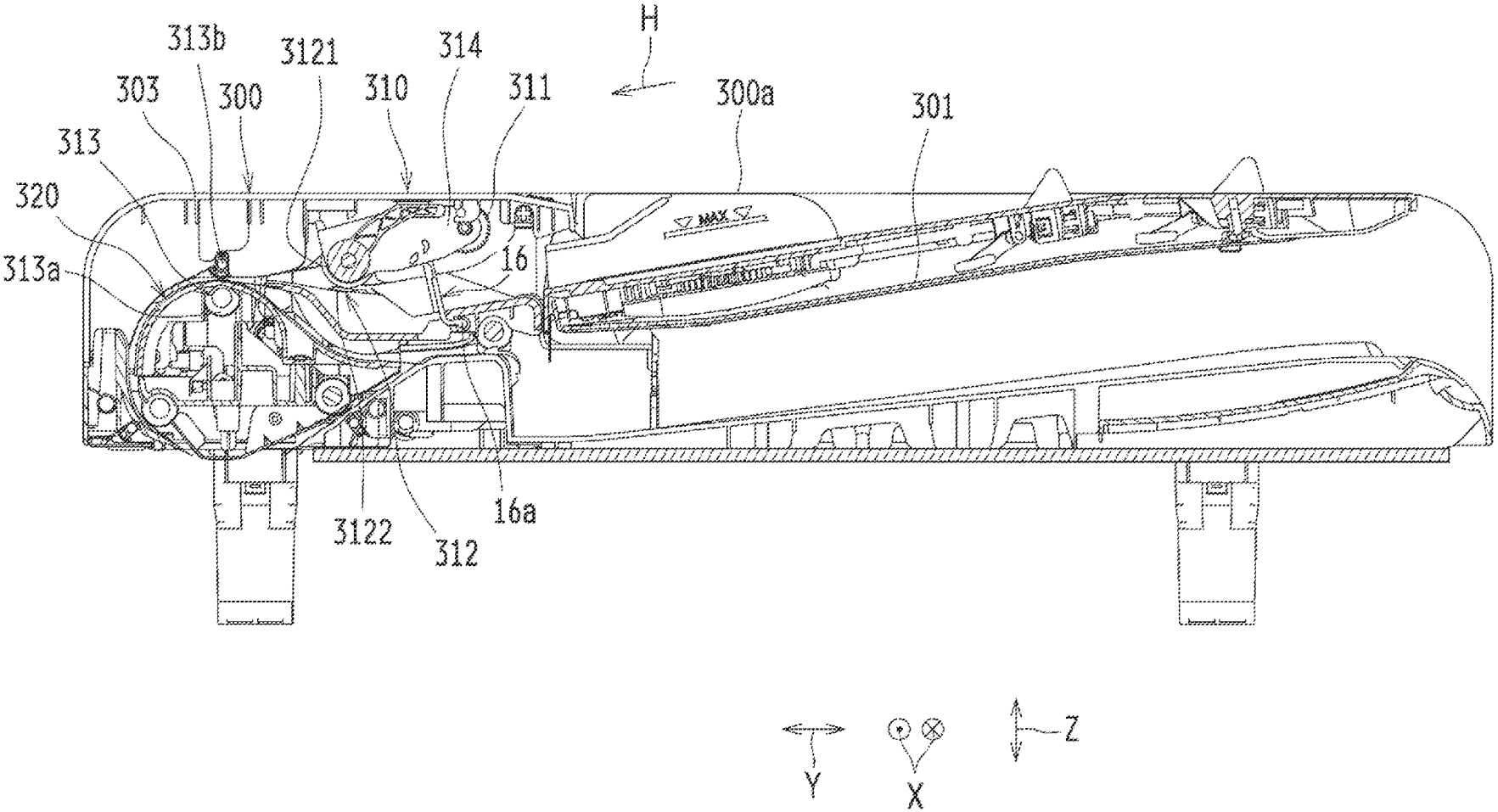
FIG. 4 is a cross-sectional view illustrating the sheet feeding device illustrated in FIG. 1.

FIG. 2 is a perspective view illustrating the sheet feeding device 300 illustrated in FIG. 1. FIG. 3 is a perspective view illustrating a state where front and rear exterior covers 307 and 308 of the sheet feeding device 300 illustrated in FIG. 1 are removed so that a sheet conveyance system 320 is exposed. FIG. 4 is a cross-sectional view illustrating the sheet feeding device 300 illustrated in FIG. 1.

Figure 5:
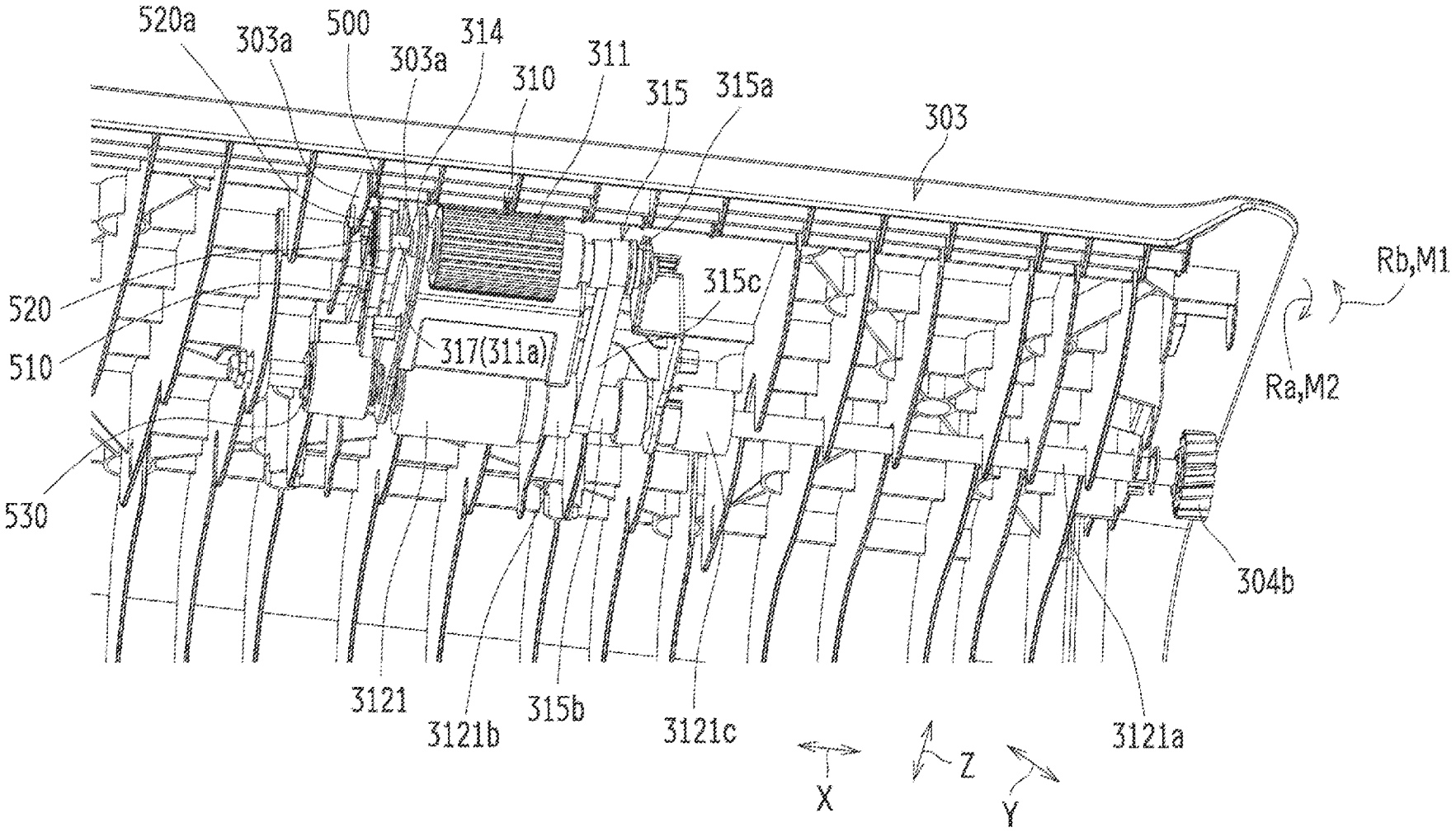
FIG. 5 is a perspective view of a portion of a sheet supplier of an opening/closing cover member in an open state as viewed from below.
Figure 6A:
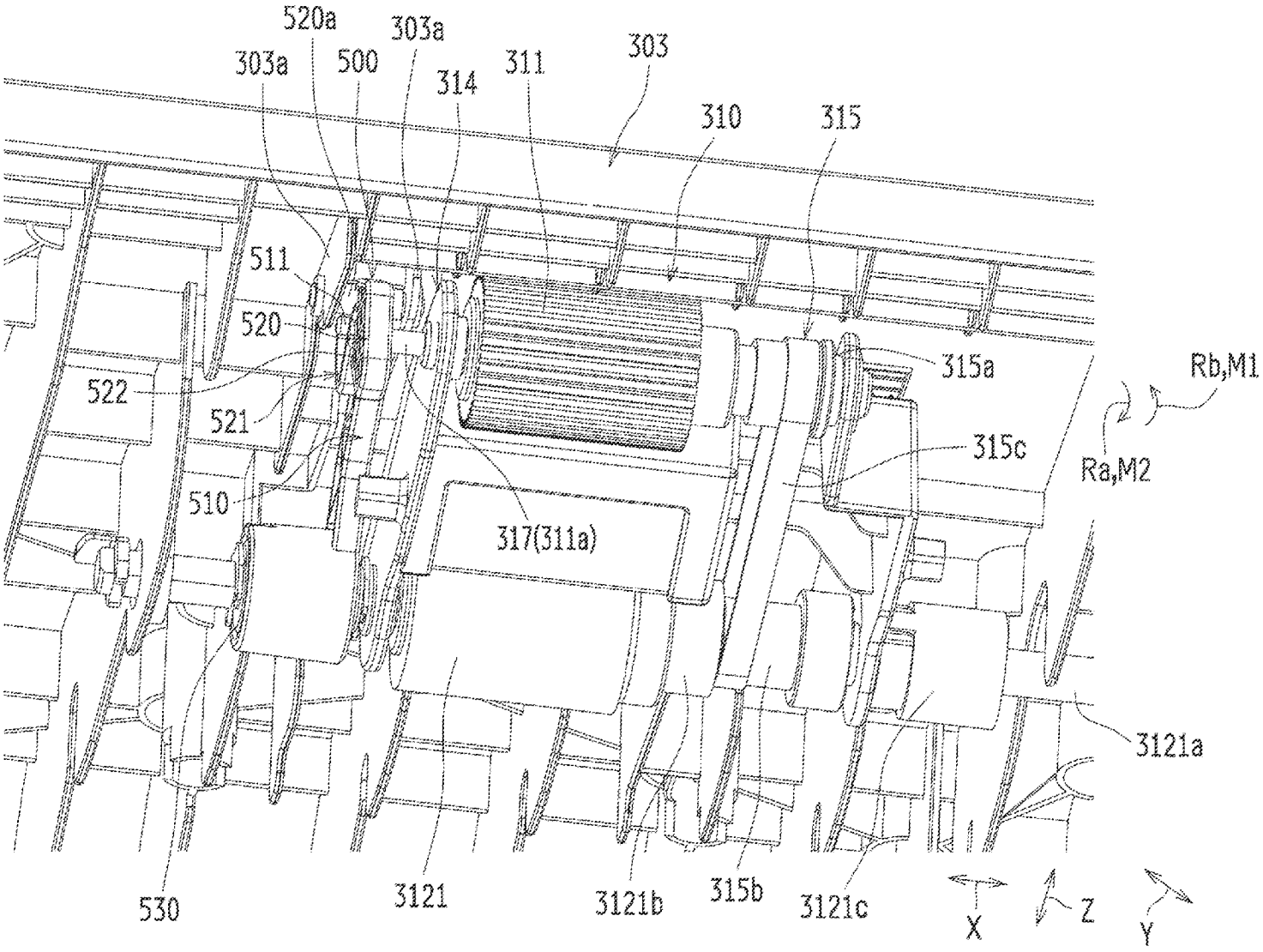
FIG. 6A is an enlarged perspective view illustrating the portion of the sheet supplier of the opening/closing cover member illustrated in FIG. 5.
Figure 6B:
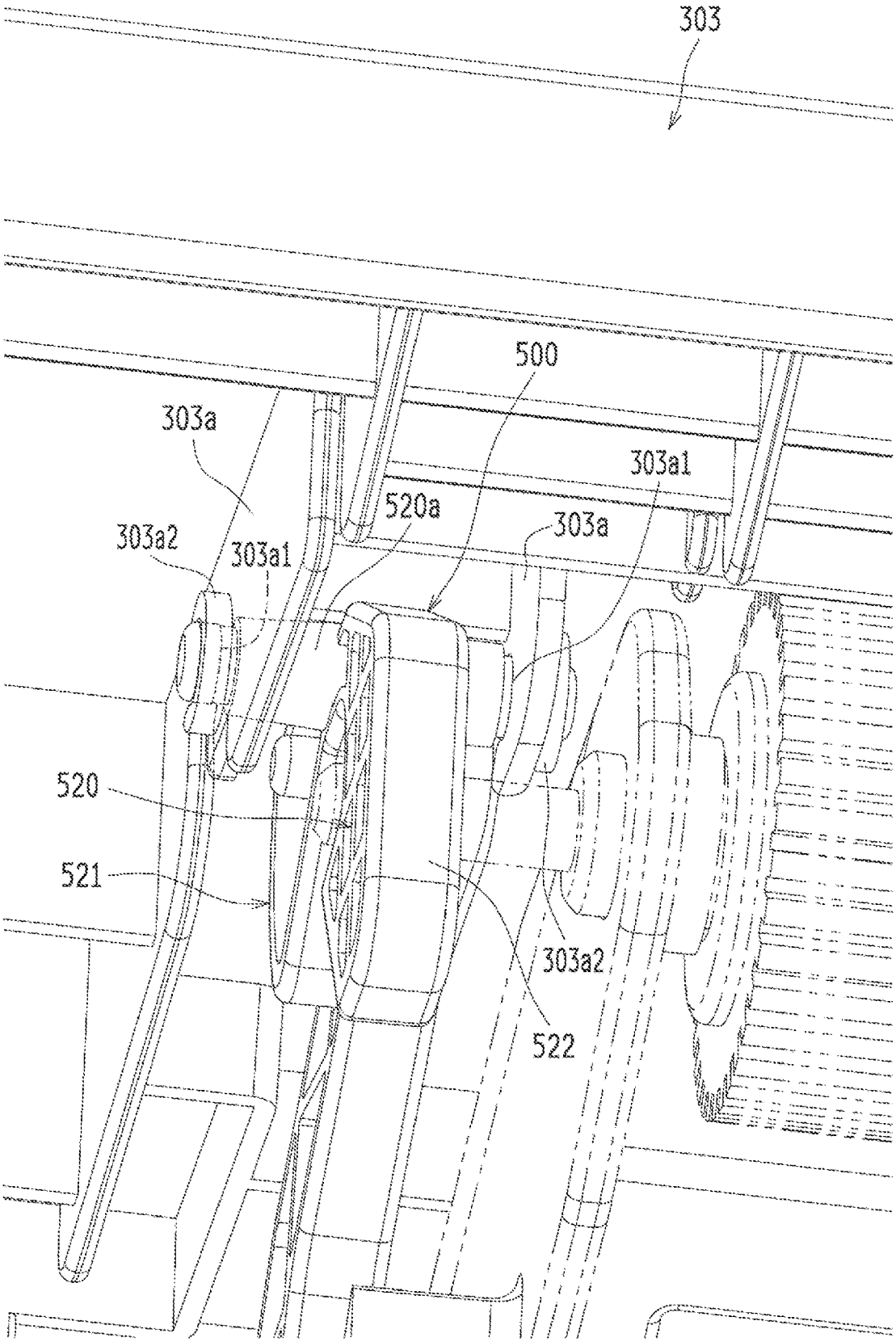
FIG. 6B is an enlarged perspective view illustrating a portion in which a second pivoting member illustrated in FIG. 6A is attached to the opening/closing cover member.
Figure 7:
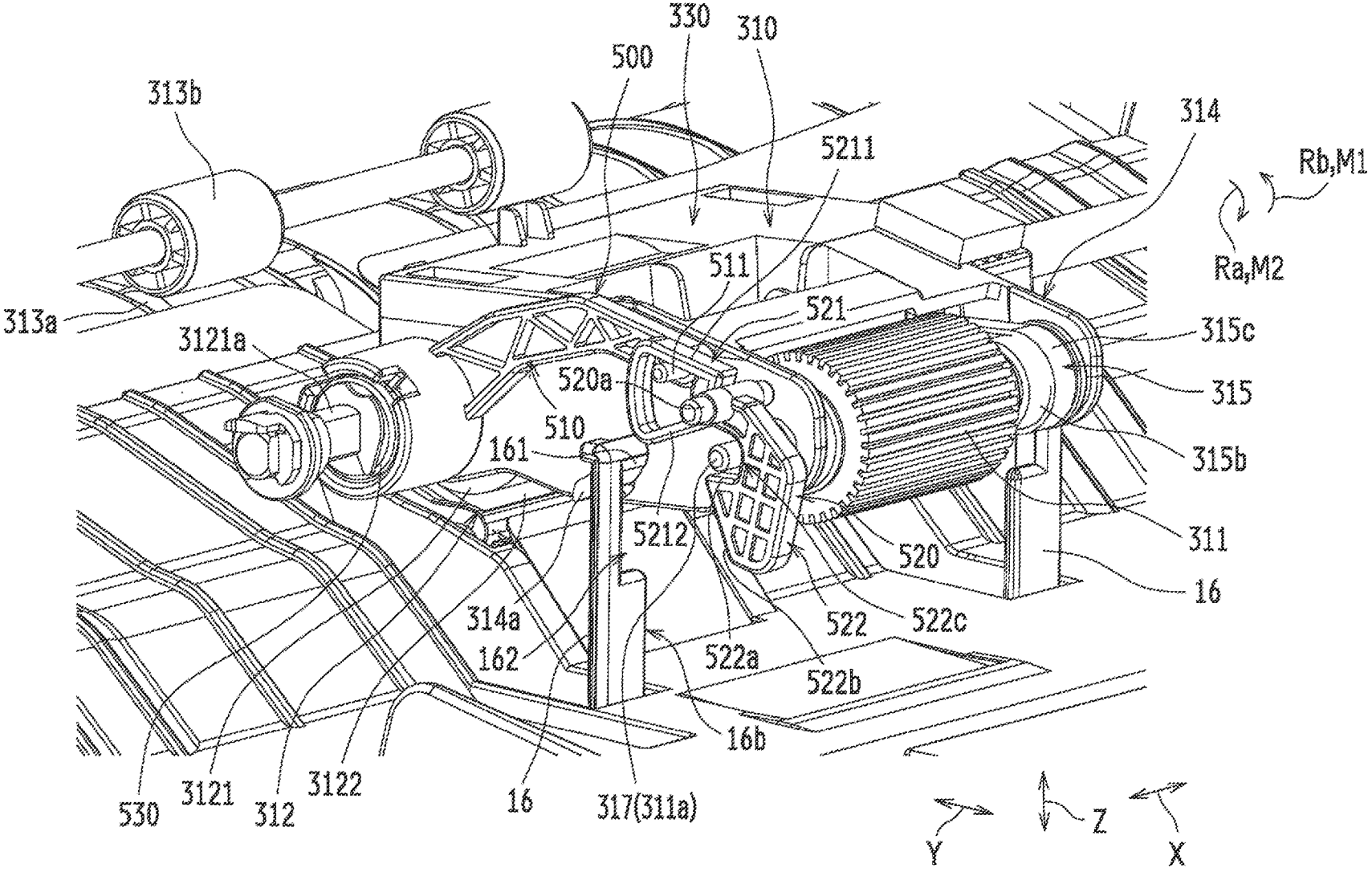
FIG. 7 is an enlarged perspective view illustrating a portion of the sheet supplier in a state where the opening/closing cover member is closed.

FIG. 5 is a perspective view of a portion of a sheet supplier 310 of an opening/closing cover member 303 in an open state as viewed from below. FIG. 6A is an enlarged perspective view illustrating the portion of the sheet supplier 310 of the opening/closing cover member 303 illustrated in FIG. 5. FIG. 6B is an enlarged perspective view illustrating a portion in which a second pivoting member 520 illustrated in FIG. 6A is attached to the opening/closing cover member 303. FIG. 7 is an enlarged perspective view illustrating a portion of the sheet supplier 310 in a state where the opening/closing cover member 303 is closed. In FIG. 7, the opening/closing cover member 303 is not illustrated.

Figure 8A:
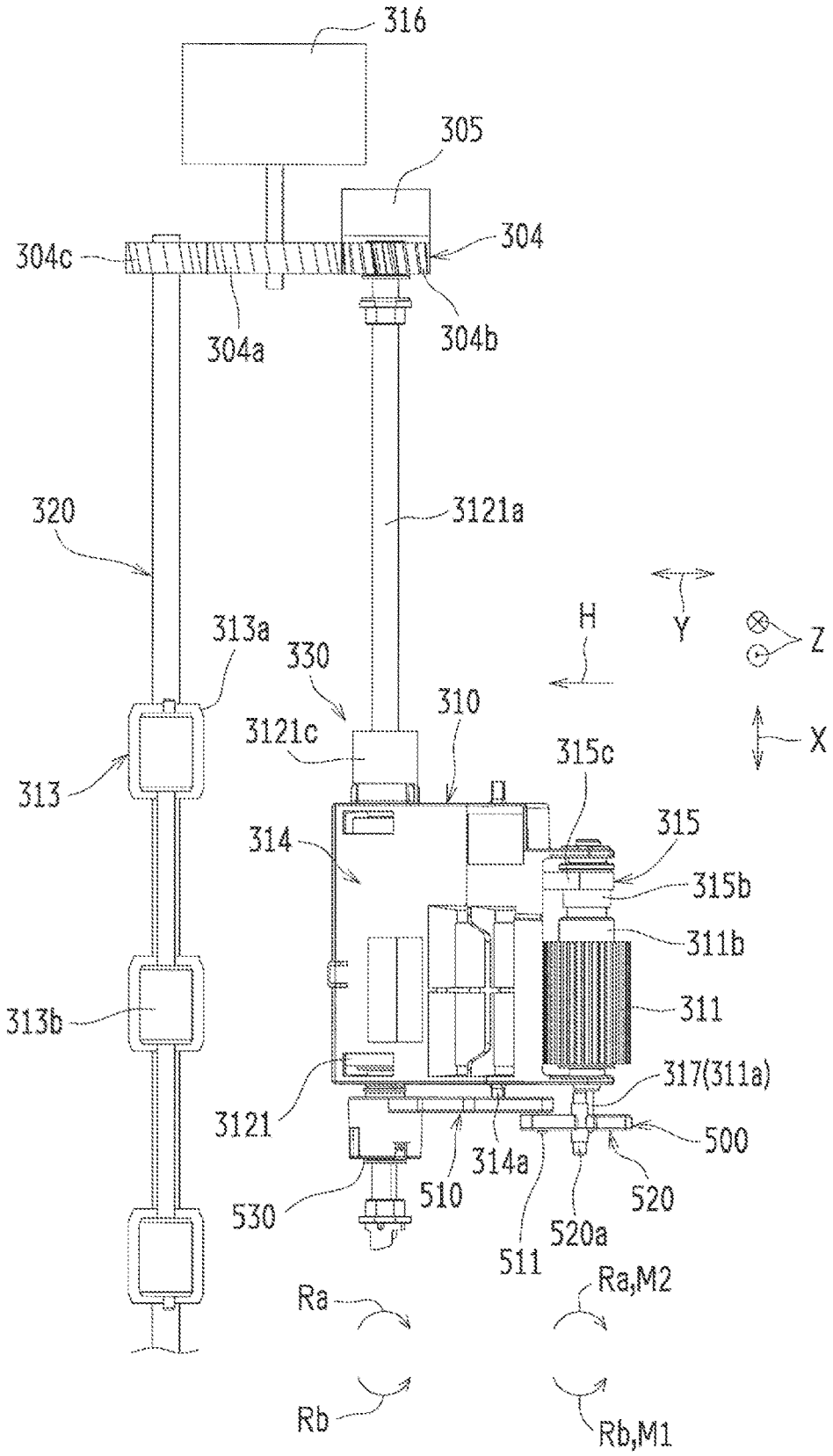
FIG. 8A is a plan view illustrating the sheet supplier in the sheet feeding device illustrated in FIG. 1.
Figure 8B:
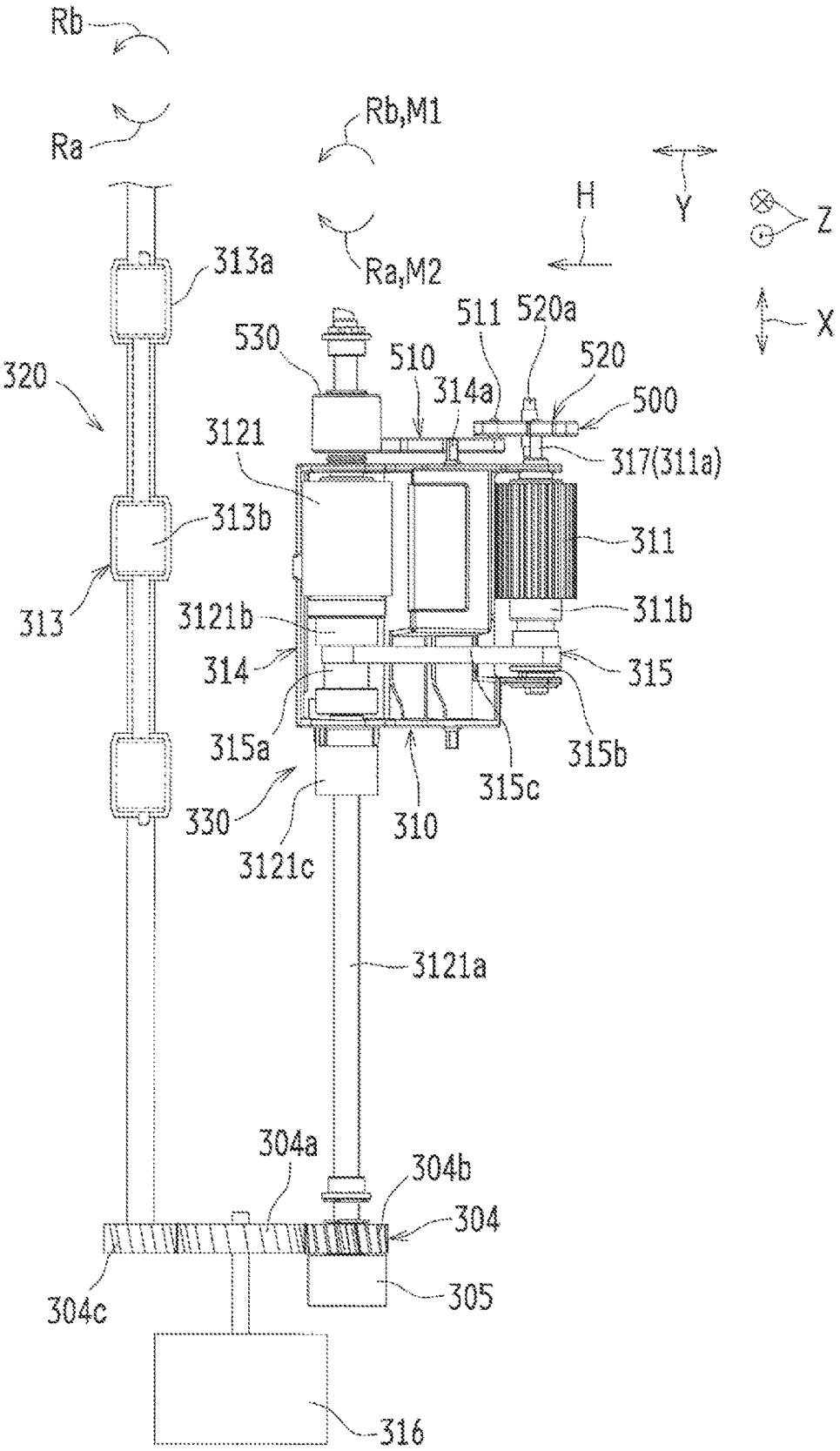
FIG. 8B is a bottom view illustrating the sheet supplier in the sheet feeding device illustrated in FIG. 1.
Figure 9:
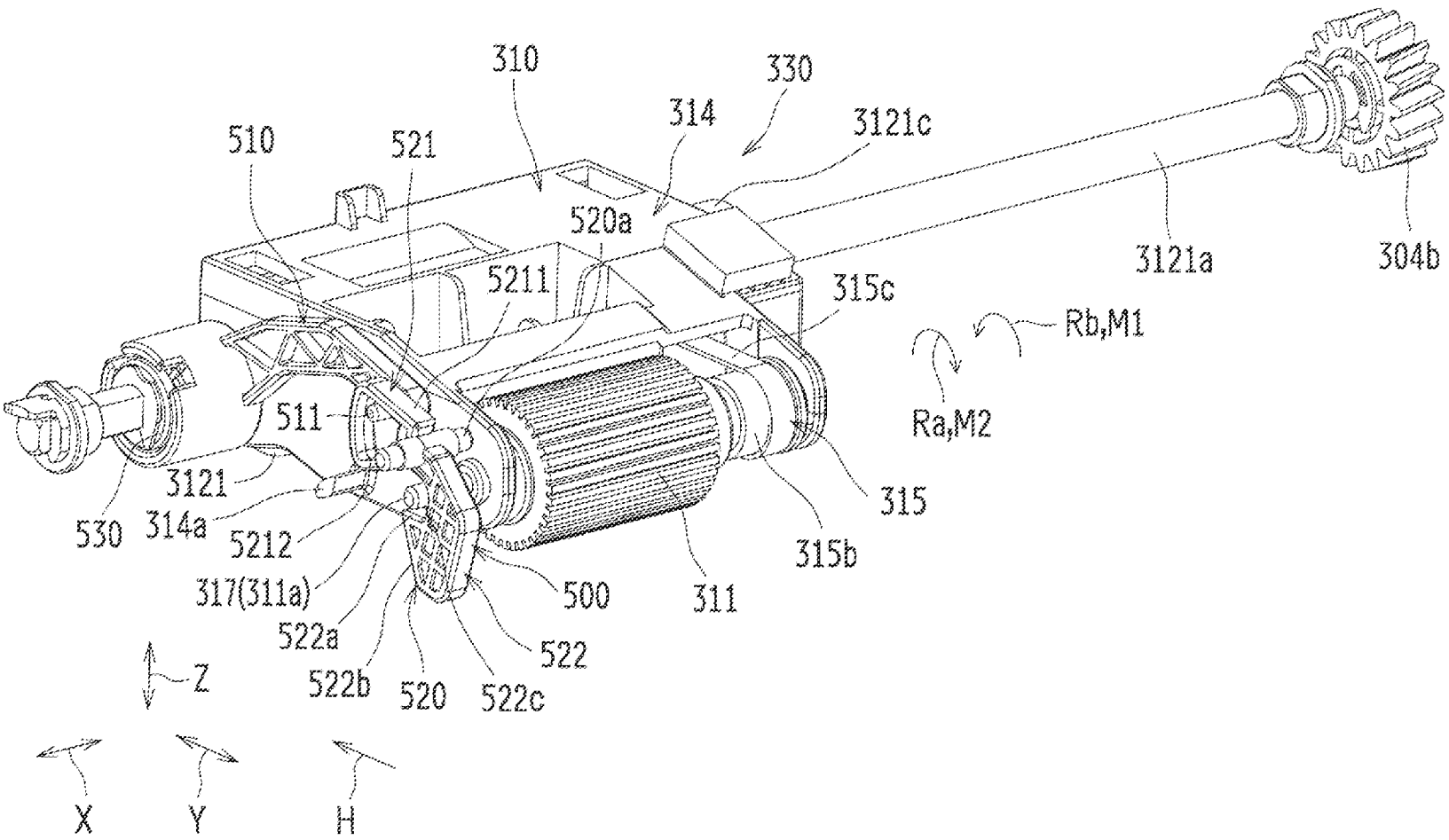
FIG. 9 is a perspective view of the sheet supplier of the sheet feeding device as viewed from diagonally above on the front side.

FIGS. 8A and 8B are plan and bottom views illustrating the sheet supplier 310 in the sheet feeding device 300 illustrated in FIG. 1, respectively. FIG. 9 is a perspective view of the sheet supplier 310 of the sheet feeding device 300 as viewed from diagonally above on the front side. FIGS. 10A to 10E are front views illustrating first to fifth lifting processes of lifting a pickup roller 311, respectively. FIGS. 11A to 11D are front views illustrating first to fifth lowering processes of lowering the pickup roller 311, respectively. FIG. 12 is a schematic block diagram illustrating a configuration of a system of a controller 15 in the sheet feeding device 300.

The sheet feeding device 300 includes a sheet loading tray 301, a pair of guide members 302 and 302, the sheet supplier 310, the sheet conveyance system 320, and the opening/closing cover member 303 (opening/closing member).

On the sheet loading tray 301, a plurality of documents G to G are loaded. The pair of guide members 302 and 302 restrict the movement of each of the documents G loaded on the sheet loading tray 301 in the width direction X. The guide members 302 are provided movably (slidingly) in the width direction X with respect to the sheet loading tray 301 so that the document G is guided according to the size of the document G. The guide member 302 reciprocates in the width direction X with reference to the center of the document G in the width direction X. The opening/closing cover member 303 is pivotably supported by a sheet feeding device main body 300*a* around a pivoting axis along the width direction X.

The sheet supplier 310 includes the pickup roller 311, a separator and conveyor 312, a pair of sheet conveyance rollers 313, a holding and coupling member 314 (holding member), a supply-use drive transmission mechanism 315 (drive transmission mechanism), a driver device 316 (stepping motor) (see FIGS. 3, 8A, and 8B), a conveyance-use drive transmission mechanism 304 (see FIGS. 8A and 8B), and a clutch for a supply roller 305 (electromagnetic clutch) (FIGS. 8A and 8B).

The pickup roller 311 picks up the top document G from among the documents G loaded on the sheet loading tray 301. The separator and conveyor 312 separates and conveys one by one the documents G picked up by the pickup roller 311. The separator and conveyor 312 includes a supply roller 3121 (paper feed roller) and a separation member (separation roller or separation pad (separation pad 3122 in this example)). The supply roller 3121 conveys the documents G picked up by the pickup roller 311, one by one toward the sheet conveyance rollers 313, in cooperation with the separation pad 3122. Each of the sheet conveyance rollers 313 is provided on the downstream side of the sheet supplier 310 in a sheet conveyance direction H and in the immediate vicinity of the sheet supplier 310. In this example, the sheet conveyance rollers 313 are paper stop rollers (a pair of paper stop rollers), and convey the document G fed from the separator and conveyor 312 toward a downstream member (the image reader 400) provided on the downstream side according to an operation timing of the downstream member (an image reading timing of the image reader 400).

Both the sheet conveyance rollers 313 and the sheet supplier 310 are rotationally driven by the driver device 316. In other words, the driver device 316 drives all of the supply roller 3121, the pickup roller 311, and the sheet conveyance rollers 313 (sheet conveyance system 320).

The sheet conveyance rollers 313 include a driving roller 313*a* rotationally driven by the driver device 316 and a driven roller 313*b* pressed and contacted (forming a nip) with the driving roller 313*a*. A drive rotation shaft 3121*a* of the supply roller 3121 and a rotation shaft 313*b*1 of the driven roller 313*b* are rotatably supported by the opening/closing cover member 303.

The conveyance-use drive transmission mechanism 304 transmits the rotational driving force from the driver device 316 to both the sheet conveyance system 320 and the sheet supplier 310. The conveyance-use drive transmission mechanism 304 includes a driving gear 304*a*, a first driven gear 304*b*, and a second driven gear 304*c*. The driving gear 304*a* is fixed to the drive rotation shaft of the driver device 316. The first driven gear 304*b* is fixed to the drive rotation shaft 3121*a* of the supply roller 3121. The second driven gear 304*c* is fixed to the sheet conveyance system 320 (the driving roller 313*a* of the sheet conveyance roller 313). The driving gear 304*a* meshes with both the first driven gear 304*b* and the second driven gear 304*c*. As a result, the rotational driving force from the driver device 316 is transmitted to both the sheet conveyance system 320 and the sheet supplier 310. In addition to the sheet conveyance roller 313, the sheet conveyance system 320 includes all other conveyance rollers on the downstream side of the sheet conveyance roller 313 in the sheet conveyance direction H. In the sheet conveyance system 320, the drive is transmitted from the sheet conveyance roller 313 to the other conveyance rollers.

The clutch for a supply roller 305 is provided in a drive transmission path from the driver device 316 to the supply roller 3121. The clutch for a supply roller 305 is electrically connected to an output system of the controller 15 (see FIG.

12). As a result, the clutch for a supply roller 305 switches, under an instruction of the controller 15, between a drive transmission state where a driving force from the driver device 316 is transmitted to both the sheet conveyance system 320 and the sheet supplier 310 and a drive cutoff state where a transmission of a driving force from the driver device 316 to the sheet supplier 310 is cut off.

As illustrated in FIGS. 8A and 8B, the holding and coupling member 314 rotatably holds a rotation shaft 311*a* of the pickup roller 311 and the drive rotation shaft 3121*a* of the supply roller 3121 around the rotation axis to couple the shafts so that the shafts are lined up at predetermined intervals in the left-right direction Y. The holding and coupling member 314 rotatably couples the rotation shaft 311*a* of the pickup roller 311 and the drive rotation shaft 3121*a* of the supply roller 3121.

The supply-use drive transmission mechanism 315 transmits a rotational driving force from the supply roller 3121 to the pickup roller 311. The supply-use drive transmission mechanism 315 includes a driving timing pulley 315*a*, a driven timing pulley 315*b*, and a timing belt 315*c*.

The driving timing pulley 315*a* is provided on the drive rotation shaft 3121*a* of the supply roller 3121. The driven timing pulley 315*b* is provided on the rotation shaft 311*a* of the pickup roller 311. The timing belt 315*c* is of endless type and is wound around the driving timing pulley 315*a* and the driven timing pulley 315*b*. As a result, the drive rotation shaft 3121*a* of the supply roller 3121 is rotationally driven in a forward rotation direction Ra of the sheet conveyance direction H, so that the rotation shaft 311*a* of the pickup roller 311 is rotated in the forward rotation direction Ra via the driving timing pulley 315*a*, the timing belt 315*c*, and the driven timing pulley 315*b*.

A first one-way clutch 3121*b* is provided between the supply roller 3121 and the drive rotation shaft 3121*a*. The first one-way clutch 3121*b* couples the supply roller 3121 and the drive rotation shaft 3121*a* with respect to the rotation of the drive rotation shaft 3121*a* in the forward rotation direction Ra to rotate the supply roller 3121 in the forward rotation direction Ra along with the rotation of the drive rotation shaft 3121*a*. On the other hand, the first one-way clutch 3121*b* allows the supply roller 3121 to rotate with respect to the drive rotation shaft 3121*a* in the forward rotation direction Ra when the rotation of the drive rotation shaft 3121*a* is suspended.

A second one-way clutch 311*b* is provided between the pickup roller 311 and the rotation shaft 311*a*. The second one-way clutch 311*b* couples the pickup roller 311 and the rotation shaft 311*a* with respect to the rotation of the rotation shaft 311*a* in the forward rotation direction Ra to rotate the pickup roller 311 in the forward rotation direction Ra along with the rotation of the rotation shaft 311*a* in the forward rotation direction Ra. On the other hand, the second one-way clutch 311*b* allows the pickup roller 311 to rotate with respect to the rotation shaft 311*a* in the forward rotation direction Ra when the rotation of the rotation shaft 311*a* is suspended.

Thus, by using the first one-way clutch 3121*b* and the second one-way clutch 311*b*, both the supply roller 3121 and the pickup roller 311 are rotated in the forward rotation direction Ra even if the drive rotation of the supply roller 3121 about the drive rotation shaft 3121*a* is suspended after the leading edge of the document G reaches the sheet conveyance roller 313 (a roller nip position).

The sheet supplier 310 includes a lifting/lowering mechanism 330 for lifting and lowering the pickup roller 311. The lifting/lowering mechanism 330 includes the drive rotation shaft 3121*a*, the holding and coupling member 314 (holding member), and the supply-use drive transmission mechanism 315 (drive transmission mechanism). The drive rotation shaft 3121*a* is rotatably supported around the rotation axis by the sheet feeding device main body 300*a* and is rotationally driven by the driver device 316. The holding and coupling member 314 is swingably supported by the drive rotation shaft 3121*a* via a torque limiter 3121*c* (a torque limiter for holding and coupling member). The holding and coupling member 314 rotatably holds the rotation shaft 311*a* of the pickup roller 311 around the rotation axis. The supply-use drive transmission mechanism 315 transmits the rotational driving force from the drive rotation shaft 3121*a* to the pickup roller 311. The controller 15 lifts and lowers the pickup roller 311 by the rotation of the drive rotation shaft 3121*a* from the driver device 316.

Specifically, the torque limiter 3121*c* is provided between the holding and coupling member 314 and the drive rotation shaft 3121*a*. The torque limiter 3121*c* restricts the rotation of the holding and coupling member 314 with respect to the drive rotation shaft 3121*a* if the holding and coupling member 314 receives a predetermined load or less with respect to the rotation of the drive rotation shaft 3121*a*. In other words, the holding and coupling member 314 rotates along with the rotation of the drive rotation shaft 3121*a*. On the other hand, if the holding and coupling member 314 receives a load above the predetermined load with respect to the rotation of the drive rotation shaft 3121*a*, the holding and coupling member 314 is allowed to rotate with respect to the drive rotation shaft 3121*a*. In other words, the drive rotation shaft 3121*a* rotates while the holding and coupling member 314 is suspended. As a result, the holding and coupling member 314 is swiveled if the holding and coupling member 314 receives a predetermined load or less with respect to the rotation of the drive rotation shaft 3121*a*. Accordingly, the pickup roller 311 is lowered by rotating in the forward rotation direction Ra, while the pickup roller 311 is lifted by rotating in a reverse rotation direction Rb. If the holding and coupling member 314 abuts against the opening/closing cover member 303 or the document G on the sheet loading tray 301 with respect to the rotation of the drive rotation shaft 3121*a*, and thus, receives a load above the predetermined load, the drive rotation shaft 3121*a* is rotated with respect to the holding and coupling member 314. In other words, the drive rotation shaft 3121*a* rotates while the holding and coupling member 314 is suspended. As a result, when the drive rotation shaft 3121*a* rotates in the forward rotation direction Ra, the pickup roller 311 is swiveled in the forward rotation direction Ra about the drive rotation shaft 3121*a* serving as a swivel shaft, so that the pickup roller 311 is pressed from above the document G on the sheet loading tray 301. Further, when the rotation shaft 311*a* rotates in the forward rotation direction Ra along with the rotation of the drive rotation shaft 3121*a* in the forward rotation direction Ra, the highest document G is fed in the sheet conveyance direction H by the rotation of the pickup roller 311 in the forward rotation direction Ra. On the other hand, when the drive rotation shaft 3121*a* rotates in the reverse rotation direction Rb, the pickup roller 311 is swiveled in the reverse rotation direction Rb about the drive rotation shaft 3121*a* serving as a swivel shaft, so that the holding and coupling member 314 abuts against the opening/closing cover member 303, and thus the pickup roller 311 is positioned at the lifted position.

The separation pad 3122 is arranged to face the supply roller 3121. The separation pad 3122 restricts all documents G except the top and bottom documents from among the documents G loaded on the sheet loading tray 301 from being conveyed in the sheet conveyance direction H, and allows the bottom document (last document G) to be conveyed in the sheet conveyance direction H.

In the present embodiment, the lifting/lowering mechanism 330 includes a holding mechanism 500 (restricting member) that releasably holds the pickup roller 311 at the lifted position of the pickup roller 311. The holding mechanism 500 releasably restricts the pickup roller 311 from being lowered from the lifted position of the pickup roller 311 at the lifted position.

According to the present embodiment, the holding mechanism 500 releasably holds the pickup roller 311 at the lifted position, so that the pickup roller 311 is securely held at the lifted position.

Incidentally, in the conventional sheet feeding device, typically, a supply driver device (supply drive motor) for driving the supply roller and the pickup roller and a conveyance driver device (conveyance drive motor) for driving a sheet conveyance roller are separately provided. In such a conventional sheet feeding device, the supply driver device lifts the pickup roller when sheets are loaded on the sheet loading tray, the pickup roller is lowered when a sheet is picked up, and the conveyance driver device conveys the sheet picked up by the pickup roller from the supply roller toward the sheet conveyance roller.

However, in the conventional sheet feeding device, it is necessary to provide two driver devices (drive motors), which increases the cost. Accordingly, as in the present embodiment, it is conceivable that the supply roller 3121, the pickup roller 311, and the sheet conveyance roller 313 are all driven by the single driver device 316. However, in this case, even if the driver device 316 lowers the pickup roller 311 to pick up the document G and the supply roller 3121 conveys the document G picked up by the pickup roller 311 toward the sheet conveyance roller 313, the pickup roller 311 is not held at the lifted position. Therefore, when documents G are loaded on the sheet loading tray 301, the pickup roller 311 is an obstacle, and the documents G is not loaded on the sheet loading tray 301.

In this regard, in the present embodiment, the holding mechanism 500 releasably holds the pickup roller 311 at the lifted position, and thus, the pickup roller 311 is securely held at the lifted position, and therefore, when documents G are loaded on the sheet loading tray 301, the documents G are loaded on the sheet loading tray 301. In addition, if the single driver device 316 drives all of the supply roller 3121, the pickup roller 311, and the sheet conveyance roller 313, it is possible to reduce the cost accordingly.

In the present embodiment, the holding mechanism 500 includes a first pivoting member 510 (first lever member) and the second pivoting member 520 (second lever member). The first pivoting member 510 is provided on the drive rotation shaft 3121*a* of the supply roller 3121. The second pivoting member 520 is provided in the opening/closing cover member 303 (a sheet feeding device main body member which is a member on a side of the sheet feeding device main body 300*a*) provided on the side of the sheet feeding device main body 300*a* such that the second pivoting member 520 rotates around the pivoting axis along the drive rotation shaft 3121*a* of the supply roller 3121. In this example, a pivoting shaft 520*a* of the second pivoting member 520 is pivotably supported by pivoting supports 303*a* (see FIGS. 5, 6A, and 6B) of the opening/closing cover member 303. Specifically, as illustrated in FIG. 6B, each of the pivoting supports 303*a* is a rib provided on the opening/closing cover member 303, and the rib is provided with a recess 303*a*1. The pivoting shaft 520*a* of the second pivoting member 520 is rotatably locked by a locking member 303*a*2 in a state of being fitted in the recess 303*a*1.

The first pivoting member 510 is provided with a first engagement 511. The second pivoting member 520 is provided with a second engagement 521 and a locking device 522*a*. The second engagement 521 engages with the first engagement 511 to pivot by pivot of the first pivoting member 510 along with pivot of the drive rotation shaft 3121*a* of the supply roller 3121 in a first pivot direction M1 (reverse rotation direction Rb), and thus, the second pivoting member 520 pivots accordingly, so that the locking device 522*a* locks the pickup roller 311 at the lifted position.

This makes it possible to realize a configuration in which the pickup roller 311 is held at the lifted position in a simple configuration including the first pivoting member 510 and the second pivoting member 520.

In the present embodiment, the first pivoting member 510 is provided on the drive rotation shaft 3121*a* of the supply roller 3121 via a torque limiter 530 for a pivoting member.

Use of the torque limiter 530 for a pivoting member makes it possible to pivot the first pivoting member 510 along with the rotation of the drive rotation shaft 3121*a* of the supply roller 3121 if the first pivoting member 510 receives a predetermined load or less with respect to the rotation of the drive rotation shaft 3121*a* of the supply roller 3121. On the other hand, if the first pivoting member 510 abuts against the second engagement 521, and the first pivoting member 510 receives a load above the predetermined load with respect to the rotation in the first pivot direction M1 (reverse rotation direction Rb) of the drive rotation shaft 3121*a* of the supply roller 3121 or the rotation in a second pivot direction M2 (forward rotation direction Ra), which is opposite to the first pivot direction M1, the pivot of the first pivoting member 510 is restricted by the second engagement 521 while the drive rotation shaft 3121*a* of the supply roller 3121 is allowed to rotate. This makes it possible to realize a lifting and lowering operation of the supply roller 3121 with a simple configuration.

In the present embodiment, a locked device 317 locked to the locking device 522*a* in the second pivoting member 520 is the rotation shaft 311*a* of the pickup roller 311. The locking device 522*a* in the second pivoting member 520 locks the rotation shaft 311*a* (locked device 317) of the pickup roller 311.

This makes it possible for the locking device 522*a* in the second pivoting member 520 to securely lock the pickup roller 311 with the rotation shaft 311*a* of the pickup roller 311 in a state where the strength of the holding and coupling member 314 is improved by the rotation shaft 311*a* of the pickup roller 311. Here, the rotation shaft 311*a* of the pickup roller 311 may be a rotation shaft rotating along with the rotation of the pickup roller 311, or may be a rotation shaft fixed regardless of the rotation of the pickup roller 311. In this example, the rotation shaft 311*a* of the pickup roller 311 is a rotation shaft rotating along with the rotation of the pickup roller 311.

In the present embodiment, the locked device 317 to be locked to the locking device 522*a* in the second pivoting member 520 may be provided on the holding and coupling member 314. Examples of the locked device 317 include a columnar protrusion protruding outward in the direction of the rotation axis of the rotation shaft 311*a*. The locking device 522*a* in the second pivoting member 520 may lock the locked device 317 in the holding and coupling member 314. This makes it possible for the locking device 522*a* in the second pivoting member 520 to securely lock the pickup roller 311 by the locked device 317 in the holding and coupling member 314 with a simple configuration in which the locked device 317 is provided on the holding and coupling member 314.

In this example, the second pivoting member 520 has a sliding contact 522*b* (slidingly contacting surface). The sliding contact 522*b* pivots the holding and coupling member 314 in the first pivot direction M1 by sliding and contacting the locked device 317. The sliding contact 522*b* is adjacent to the locking device 522*a*. The second pivoting member 520 once pivots in the first pivot direction M1 if the sliding contact 522*b* slides and contacts the locked device 317, while the second pivoting member 520 pivots in the second pivot direction M2 after the locked device 317 passes a boundary between the sliding contact 522*b* and the locking device 522*a*. Then, the locked device 317 enters the locking device 522*a*, and the second pivoting member 520 is locked to the locked device 317 with the locking device 522*a*.

Incidentally, if the second pivoting member 520 pivots immediately after the first engagement 511 of the first pivoting member 510 engages with the second engagement 521 of the second pivoting member 520, a period during which the second pivoting member 520 pivots is longer. This makes it easy to apply a load to the first pivoting member 510 and the second pivoting member 520.

In this regard, in the present embodiment, the second engagement 521 includes a first pivot direction engagement 5211 and a second pivot direction engagement 5212. The second pivot direction engagement 5212 is provided apart from the first pivot direction engagement 5211 in the first pivot direction M1. The first engagement 511 is arranged between the first pivot direction engagement 5211 and the second pivot direction engagement 5212 in the second engagement 521. The first pivot direction engagement 5211 engages with the first engagement 511 when the first pivoting member 510 pivots in the first pivot direction M1. The second pivot direction engagement 5212 engages with the second engagement 521 when the first pivoting member 510 pivots in the second pivot direction M2, which is opposite to the first pivot direction M1. Instead of the second engagement 521, the first engagement 511 may include a first pivot direction engagement and a second pivot direction engagement, and the second engagement 521 may be arranged between the first pivot direction engagement and the second pivot direction engagement in the first engagement 511.

This makes it possible to pivot the second pivoting member 520 after a while, and the first engagement 511 engages with the second engagement 521, so that a period during which the second pivoting member 520 pivots is shortened accordingly. This makes it difficult to apply a load to the first pivoting member 510 and the second pivoting member 520.

The first pivoting member 510 extends outward in the radial direction of the supply roller 3121. The first engagement 511 is formed at the tip end of the first pivoting member 510. The first engagement 511 is a columnar protrusion protruding outward in the direction of the rotation axis of the supply roller 3121. The second pivoting member 520 has the second engagement 521 and a sliding contacting and locking device 522. The second engagement 521 and the sliding contacting and locking device 522 are formed on one side and the other side across the pivoting shaft 520*a* of the second pivoting member 520, respectively. The second engagement 521 and the sliding contacting and locking device 522 are integrally formed. The sliding contacting and locking device 522 includes the locking device 522*a* and the sliding contact 522*b*. The locking device 522*a* and the sliding contact 522*b* are integrally formed. The angle formed by the locking device 522*a* and the sliding contact 522*b* is an acute angle. A U-shaped recess 522*c* is formed in the sliding contacting and locking device 522, and a part of the recess 522*c* constitutes the locking device 522*a*.

In the holding mechanism 500 described above, to lift and hold the pickup roller 311 at the lifted position, the following operations are performed. That is, the following processes are performed.

First Lifting Process

Figure 10A:
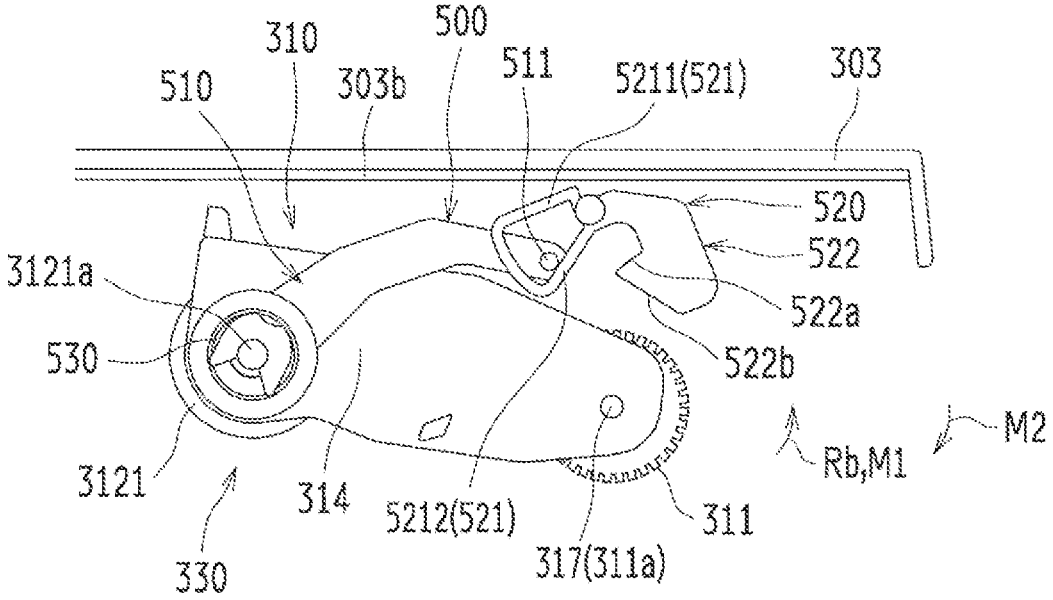
FIG. 10A is a front view illustrating a first lifting process of lifting the pickup roller.

As illustrated in FIG. 10A, in the state where the pickup roller 311 abuts against the document G on the sheet loading tray 301 and the first engagement 511 is lowered, the first engagement 511 in the first pivoting member 510 engages with the second pivot direction engagement 5212 of the second engagement 521 in the second pivoting member 520. At this time, the locking device 522*a* in the second pivoting member 520 is located at a retracted position retracted from the locking position with the locked device 317 (311*a*). To lift and hold the pickup roller 311 at the lifted position, the drive rotation shaft 3121*a* of the supply roller 3121 is rotated in the reverse rotation direction Rb.

Second Lifting Process

Figure 10B:
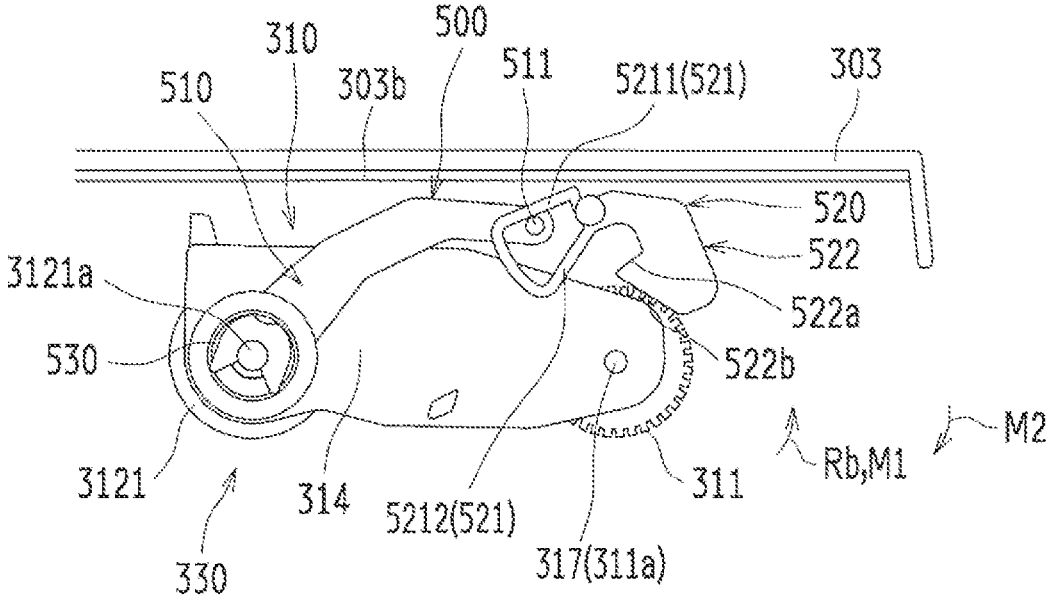
FIG. 10B is a front view illustrating a second lifting process of lifting the pickup roller.

When the drive rotation shaft 3121*a* of the supply roller 3121 rotates in the reverse rotation direction Rb, as illustrated in FIG. 10B, the holding and coupling member 314 pivots in the first pivot direction M1 to lift the pickup roller 311 and also the first pivoting member 510 pivots in the first pivot direction M1 to lift the first engagement 511. Then, the first engagement 511 engages with the first pivot direction engagement 5211 of the second engagement 521 in the second pivoting member 520.

Third Lifting Process

Figure 10C:
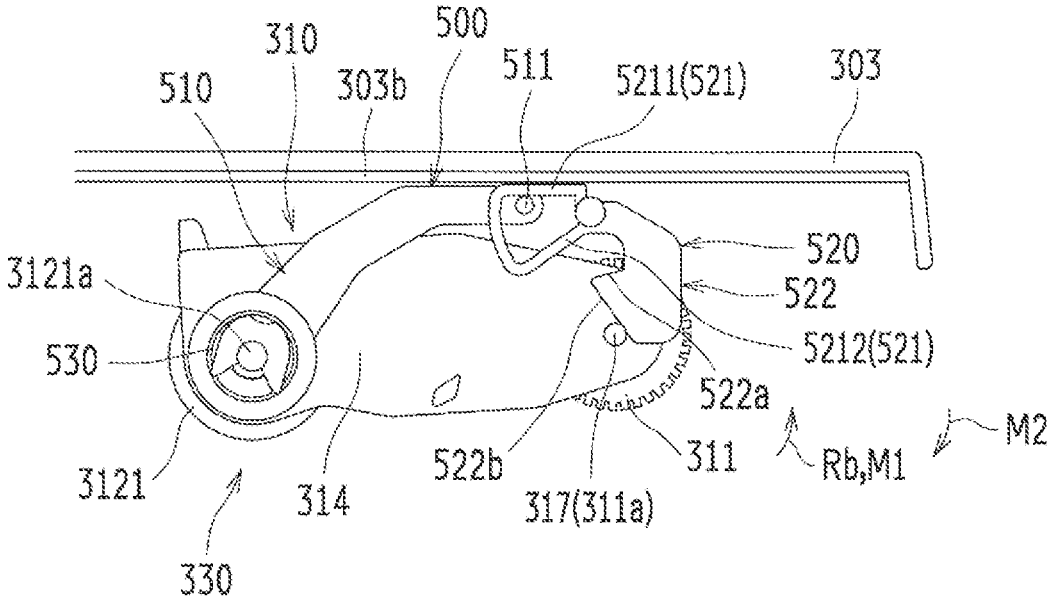
FIG. 10C is a front view illustrating a third lifting process of lifting the pickup roller.

When the drive rotation shaft 3121*a* further rotates in the reverse rotation direction Rb, as illustrated in FIG. 10C, the pickup roller 311 is further lifted and the first pivoting member 510 further also pivots in the first pivot direction M1. Then, the second pivoting member 520 pivots in the second pivot direction M2 along with the pivot of the first pivoting member 510 in the first pivot direction M1, and the locking device 522*a* in the second pivoting member 520 shifts to a locked position with the locked device 317 (311*a*). At this time, the first pivoting member 510 abuts against a restriction (303*b*) of the restricting member (opening/closing cover member 303), and thus is restricted from pivoting in the first pivot direction M1.

Fourth Lifting Process

Figure 10D:
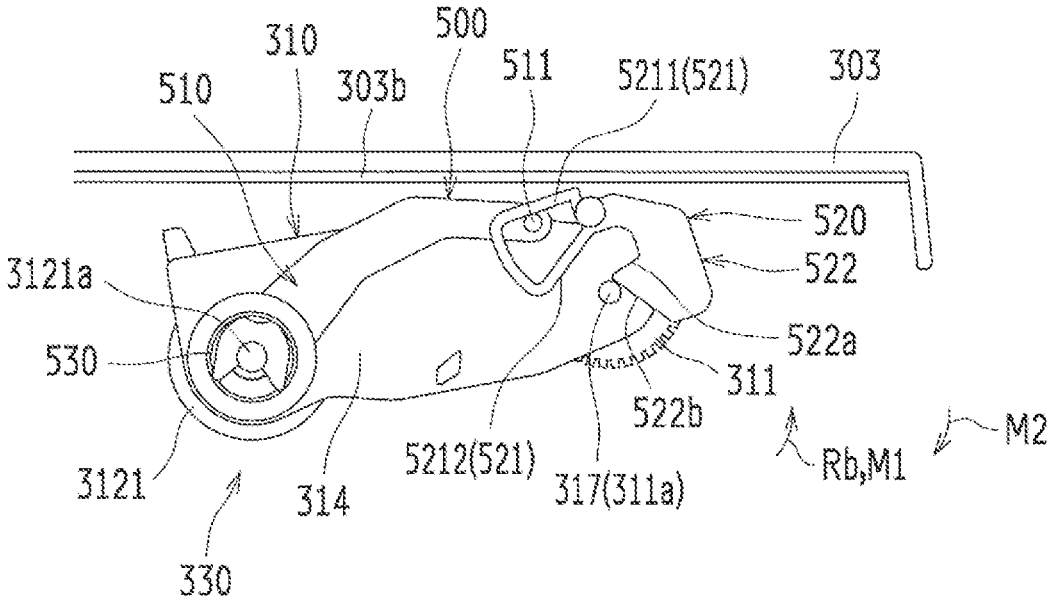
FIG. 10D is a front view illustrating a fourth lifting process of lifting the pickup roller.

When the drive rotation shaft 3121*a* further rotates in the reverse rotation direction Rb, as illustrated in FIG. 10D, the first pivoting member 510 is restricted by the restricting member (opening/closing cover member 303) while the holding and coupling member 314 further pivots in the first pivot direction M1. Then, the sliding contact 522*b* of the second pivoting member 520 slides and contacts the locked device 317, and the second pivoting member 520 pivots in the first pivot direction M1.

Fifth Lifting Process

Figure 10E:
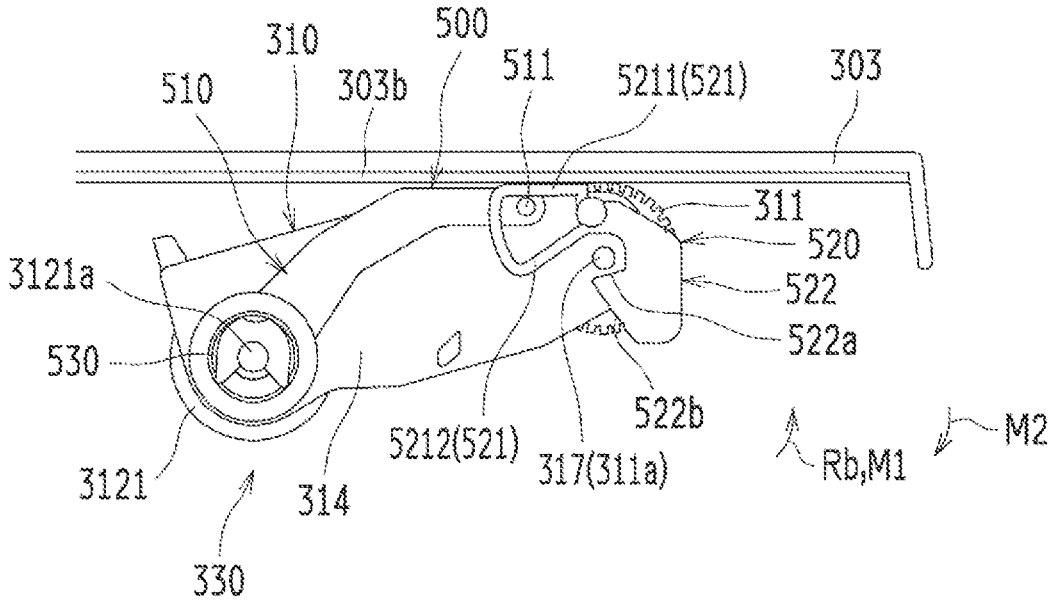
FIG. 10E is a front view illustrating a fifth lifting process of lifting the pickup roller.

When the locked device 317 passes the boundary between the sliding contact 522*b* and the locking device 522*a*, as illustrated in FIG. 10E, the second pivoting member 520 pivots in the first pivot direction M1 and the locking device 522*a* locks the locked device 317. At this time, the pickup roller 311 abuts against a restriction (303*b*) of the restricting member (opening/closing cover member 303), and thus is restricted from pivoting in the first pivot direction M1.

In the present embodiment, the second engagement 521 is formed in a ring shape. This makes it possible to improve the strength of the first pivot direction engagement 5211 and the second pivot direction engagement 5212 in the second engagement 521. The first engagement 511 may be formed in a ring shape. This makes it possible to improve the strength of the first pivot direction engagement and the second pivot direction engagement in the first engagement 511. As a result, the first engagement 511 is stably engaged with the second engagement 521.

In the present embodiment, the first engagement 511 is arranged inside the ring shape of the second engagement 521. This makes it possible to securely engage the first engagement 511 of the first pivoting member 510 with the second engagement 521. In a case where the first engagement 511 is formed in a ring shape, the second engagement 521 may be arranged inside the ring shape of the first engagement 511. This makes it possible to securely engage the second engagement 521 of the second pivoting member 520 with the first engagement 511.

In the present embodiment, the second engagement 521 engages with the first engagement 511 by the pivot of the first pivoting member 510 along with the pivot of the drive rotation shaft 3121*a* of the supply roller 3121 in the second pivot direction M2, and the second pivoting member 520 pivots accordingly, so that the locking device 522*a* is released from being locked with the pickup roller 311.

This makes it possible to provide the configuration in which the pickup roller 311 held at the lifted position is released as a simple configuration including the first pivoting member 510 and the second pivoting member 520.

In the holding mechanism 500, the following operations are performed to release the holding of the pickup roller 311 at the lifted position and lower the pickup roller 311. That is, the following processes are performed.

First Lowering Process

Figure 11A:
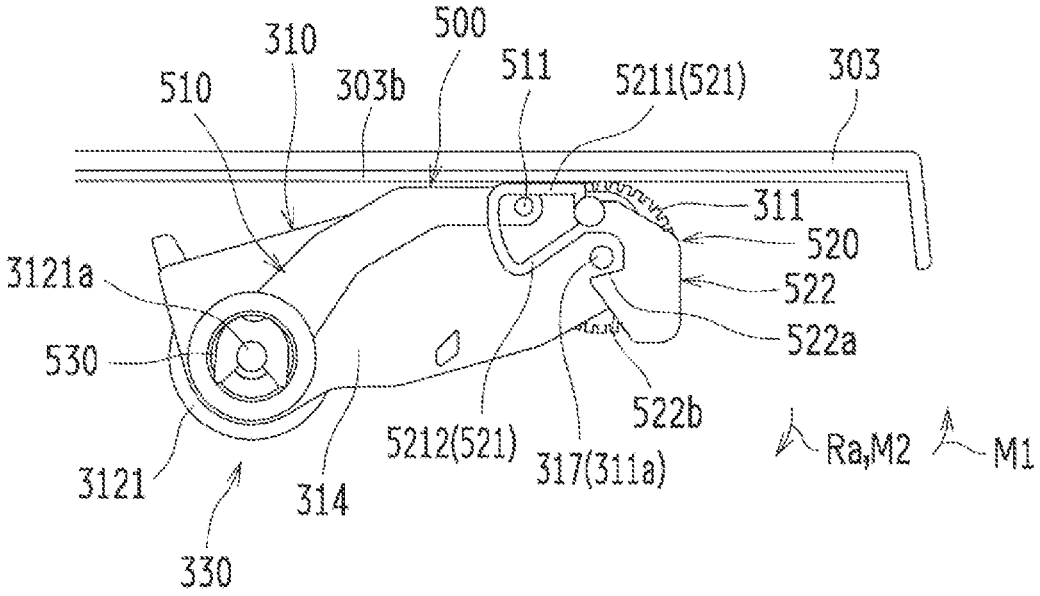
FIG. 11A is a front view illustrating a first lowering process of lowering the pickup roller.
Figure 12:
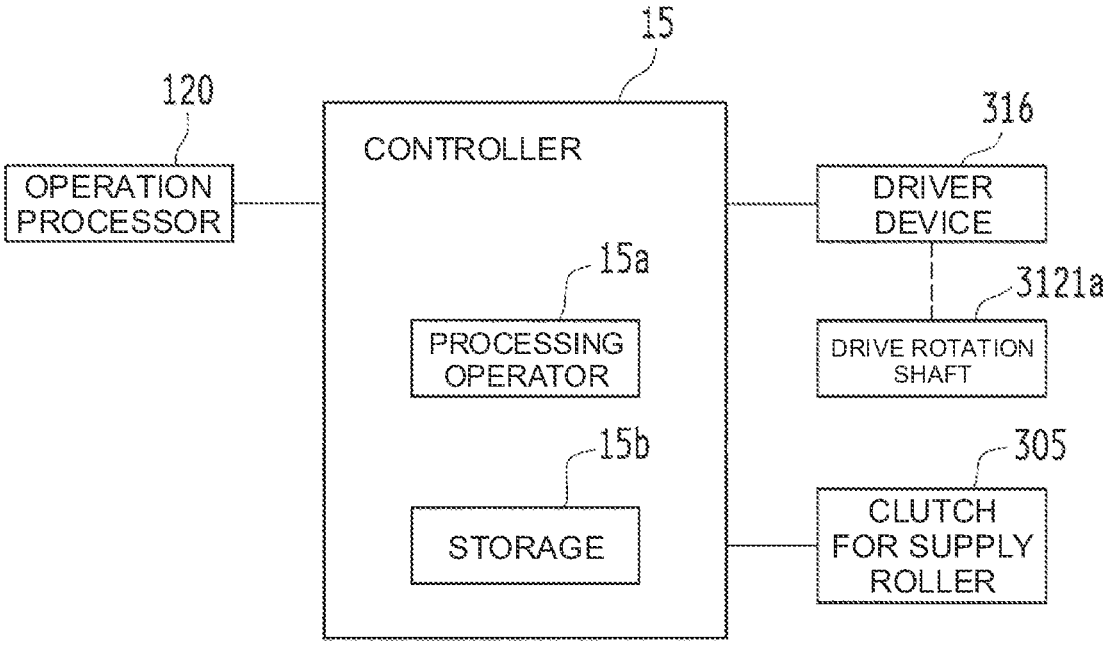
FIG. 12 is a schematic block diagram illustrating a configuration of a system of a controller in the sheet feeding device.

As illustrated in FIG. 11A, in the state where the pickup roller 311 abuts against the restriction (303*b*) of the restricting member (opening/closing cover member 303) and the first engagement 511 is lifted, the first engagement 511 in the first pivoting member 510 engages with the first pivot direction engagement 5211 of the second engagement 521 in the second pivoting member 520. At this time, the locking device 522*a* in the second pivoting member 520 is located at the locked position with the locked device 317 (311*a*). To release the holding of the pickup roller 311 at the lifted position and lower the pickup roller 311, the drive rotation shaft 3121*a* of the supply roller 3121 is rotated in the forward rotation direction Ra.

Second Lowering Process

Figure 11B:
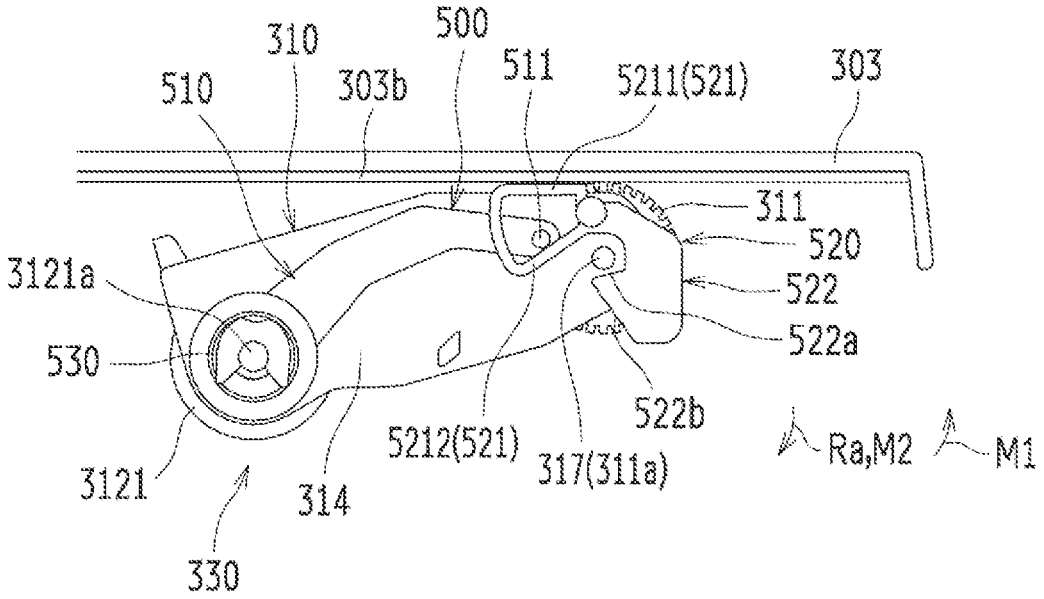
FIG. 11B is a front view illustrating a second lowering process of lowering the pickup roller.

When the drive rotation shaft 3121*a* of the supply roller 3121 rotates in the forward rotation direction Ra, as illustrated in FIG. 11B, the first pivoting member 510 pivots in the second pivot direction M2, and the first engagement 511 is lowered. Then, the first engagement 511 engages with the second pivot direction engagement 5212 of the second engagement 521 in the second pivoting member 520.

Third Lowering Process

Figure 11C:
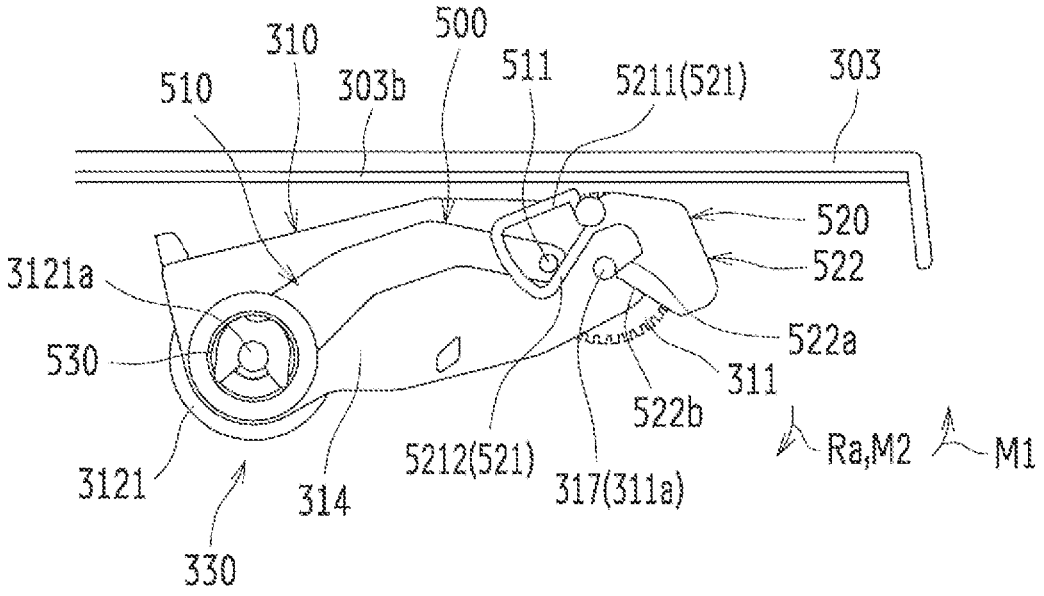
FIG. 11C is a front view illustrating a third lowering process of lowering the pickup roller.

When the drive rotation shaft 3121*a* further rotates in the forward rotation direction Ra, as illustrated in FIG. 11C, the pickup roller 311 is further lowered and the first pivoting member 510 further also pivots in the second pivot direction M2. Then, the second pivoting member 520 pivots in the first pivot direction M1 along with the pivot of the first pivoting member 510 in the second pivot direction M2, and the locking device 522*a* in the second pivoting member 520 shifts from the locked position with the locked device 317 (311*a*) to the retracted position, so that the locked device 317 (311*a*) is released from being locked by the locking device 522*a*.

Fourth Lowering Process

Figure 11D:
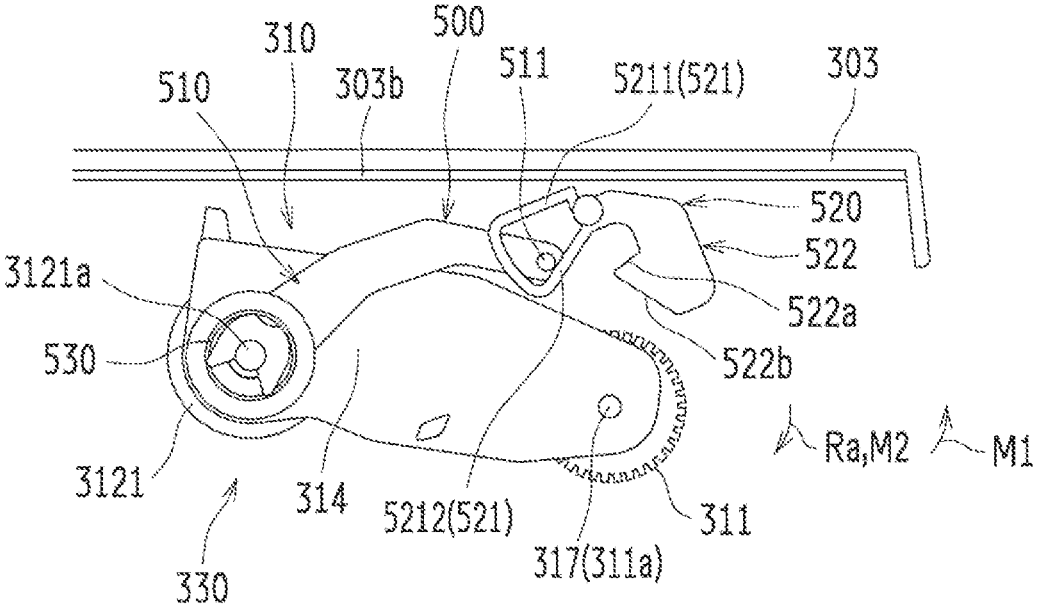
FIG. 11D is a front view illustrating a fourth lowering process of lowering the pickup roller.

When the locked device 317 (311*a*) is released from being locked by the locking device 522*a*, as illustrated in FIG. 11D, the holding and coupling member 314 pivots in the second pivot direction M2, and the pickup roller 311 abuts against the document G on the sheet loading tray 301, and thus, is restricted from pivoting in the second pivot direction M2.

In the present embodiment, as illustrated in FIG. 7, the holding and coupling member 314 restricts the first pivoting member 510 from moving to one side (back side) in the pivoting axis direction (width direction X) of the supply roller 3121.

This makes it possible for the holding and coupling member 314 to prevent the first engagement 511 of the first pivoting member 510 from being detached from the second engagement 521 of the second pivoting member 520.

In the present embodiment, the first pivoting member 510 is arranged between the holding and coupling member 314 and the second pivoting member 520. The first pivoting member 510 is restricted from moving to both one side and the other side in the pivoting axis direction (width direction X) of the supply roller 3121.

This makes it possible for the holding and coupling member 314 and the second pivoting member 520 to securely engage the first engagement 511 and the second engagement 521.

In the sheet feeding device 300 according to the present embodiment, as illustrated in FIGS. 8A and 8B, the clutch for a supply roller 305 is provided in the drive transmission path from the driver device 316 to the supply roller 3121. The controller 15 transmits the driving force from the driver device 316 to the supply roller 3121 through the clutch for a supply roller 305 until the leading edge of the document G reaches the sheet conveyance roller 313 (sheet conveyance system 320). When the leading edge of the document G reaches the sheet conveyance roller 313 (sheet conveyance system 320), the controller 15 (see FIG. 1) cuts off the transmission of the driving force from the driver device 316 to the supply roller 3121 through the clutch for a supply roller 305.

This makes it possible to cut off the transmission of the driving force from the driver device 316 to the supply roller 3121 when the leading edge of the document G is conveyed to the sheet conveyance roller 313 (sheet conveyance system 320) closest to the downstream side of the supply roller 3121. As a result, it is possible to reduce the load applied to the document G, and to suppress the damage given to the document G accordingly. Moreover, by switching the clutch for a supply roller 305 from the cutoff state to the transmission state and pivoting the drive rotation shaft 3121*a* of the supply roller 3121 in the first pivot direction M1, the pickup roller 311 is lifted and held at the lifted position.

As illustrated in FIGS. 4 and 7, the sheet feeding device 300 according to the present embodiment includes a sheet restrictor 16 (stopper) that restricts the document G loaded on the sheet loading tray 301 from moving in the sheet conveyance direction H. The sheet restrictor 16 is pivotably supported by the sheet feeding device main body 300*a* around a pivoting axis (pivoting shaft 16*a* (see FIG. 4)) along the rotation axis of the supply roller 3121. As illustrated in FIG. 7, the holding and coupling member 314 is provided with a locking device 314*a*. The sheet restrictor 16 has a locked device 161 to be locked to the locking device

314*a* and an unlocking device 162. The locked device 161 is provided on the distal end side of a sheet restrictor main body 16*b*. The locked device 161 is a protrusion protruding toward the other side (front side) in the width direction X of the holding and coupling member 314. The unlocking device 162 is a recess or a through hole (recess in this example), and is provided adjacent to the sheet restrictor main body 16*b* on the proximal end side of the sheet restrictor main body 16*b*.

In the sheet feeding device 300, with the sheet restrictor 16, when the pickup roller 311 is located at the lifted position, the locked device 161 is locked with the locking device 314*a* of the holding and coupling member 314, and restricts the document G loaded on the sheet loading tray 301 from moving in the sheet conveyance direction H. On the other hand, with the sheet restrictor 16, when the pickup roller 311 is lowered from the lifted position, the locking device 314*a* of the holding and coupling member 314 shifts to the unlocking device 162. Then, with the sheet restrictor 16, the locked device 161 is released from being locked by the locking device 314*a* and pivots in the first pivot direction M1, and allows the document G loaded on the sheet loading tray 301 to move in the sheet conveyance direction H.

As illustrated in FIG. 12, the image forming apparatus 100 includes an operation processor 120. The controller 15 includes a processing operator 15*a* including a microcomputer such as a CPU, and a storage 15*b* including a non-volatile memory such as a ROM and a volatile memory such as a RAM. The controller 15 controls an activation of various types of constituent elements by loading onto the RAM of the storage 15*b* and executing, a control program stored in advance in the ROM of the storage 15*b*, by the processing operator 15*a*.

The operation processor 120 is connected to an input system of the controller 15, and the driver device 316 is connected to an output system of the controller 15. When the controller 15 receives an instruction signal from the operation processor 120, the controller 15 rotates and drives the driver device 316 in accordance with the received instruction signal.

Present Embodiment

Incidentally, in the sheet feeding device 300, there is a backlash (a play or a rattle) in the drive transmission system (particularly the lifting/lowering mechanism 330) in which a rotational driving force is transmitted from the driver device 316 to the pickup roller 311, and the pickup roller 311 may fall by its own weight by the amount of the backlash when the pickup roller 311 is lowered. Then, the rotational driving force from the driver device 316 has a momentum amplified resulting from its own weight falling by the amount of the backlash, which results in a loud collision noise generated when the pickup roller 311 contacts the sheet loading tray 301 or the document G on the sheet loading tray 301.

Figure 13A:
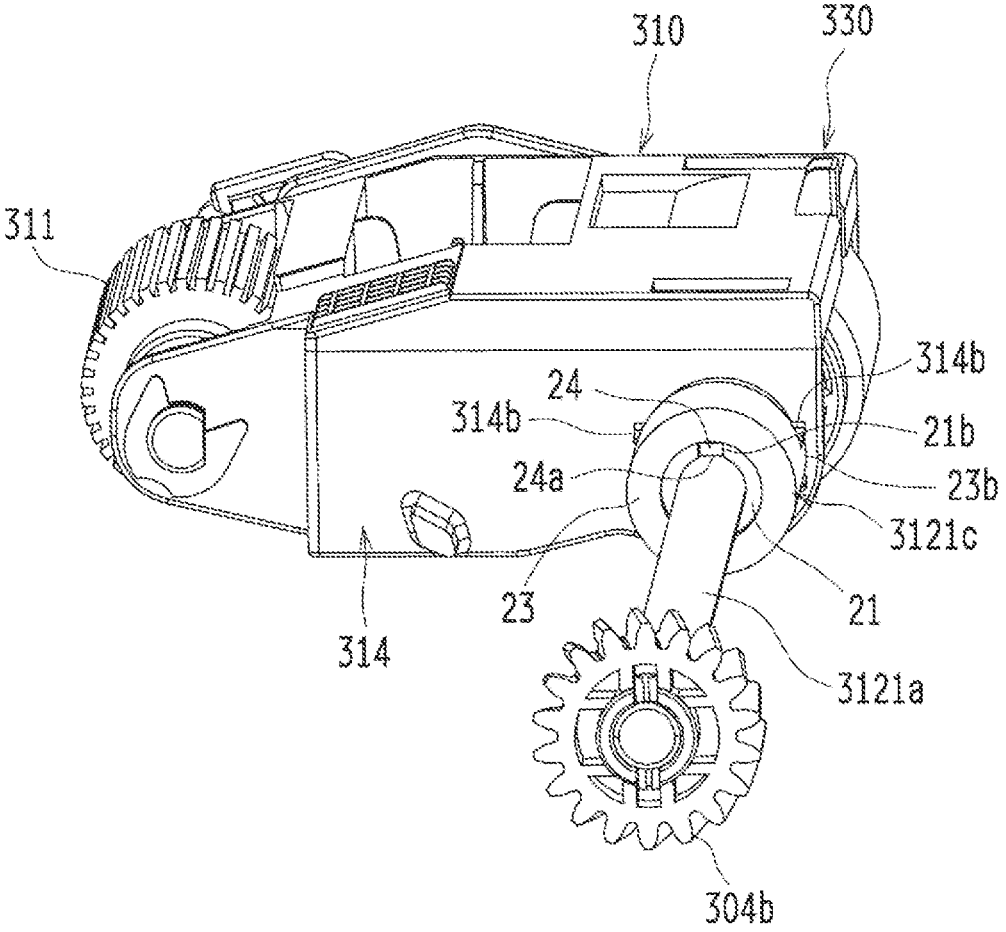
FIG. 13A is a perspective view illustrating a portion of a torque limiter in the sheet supplier.
Figure 13B:
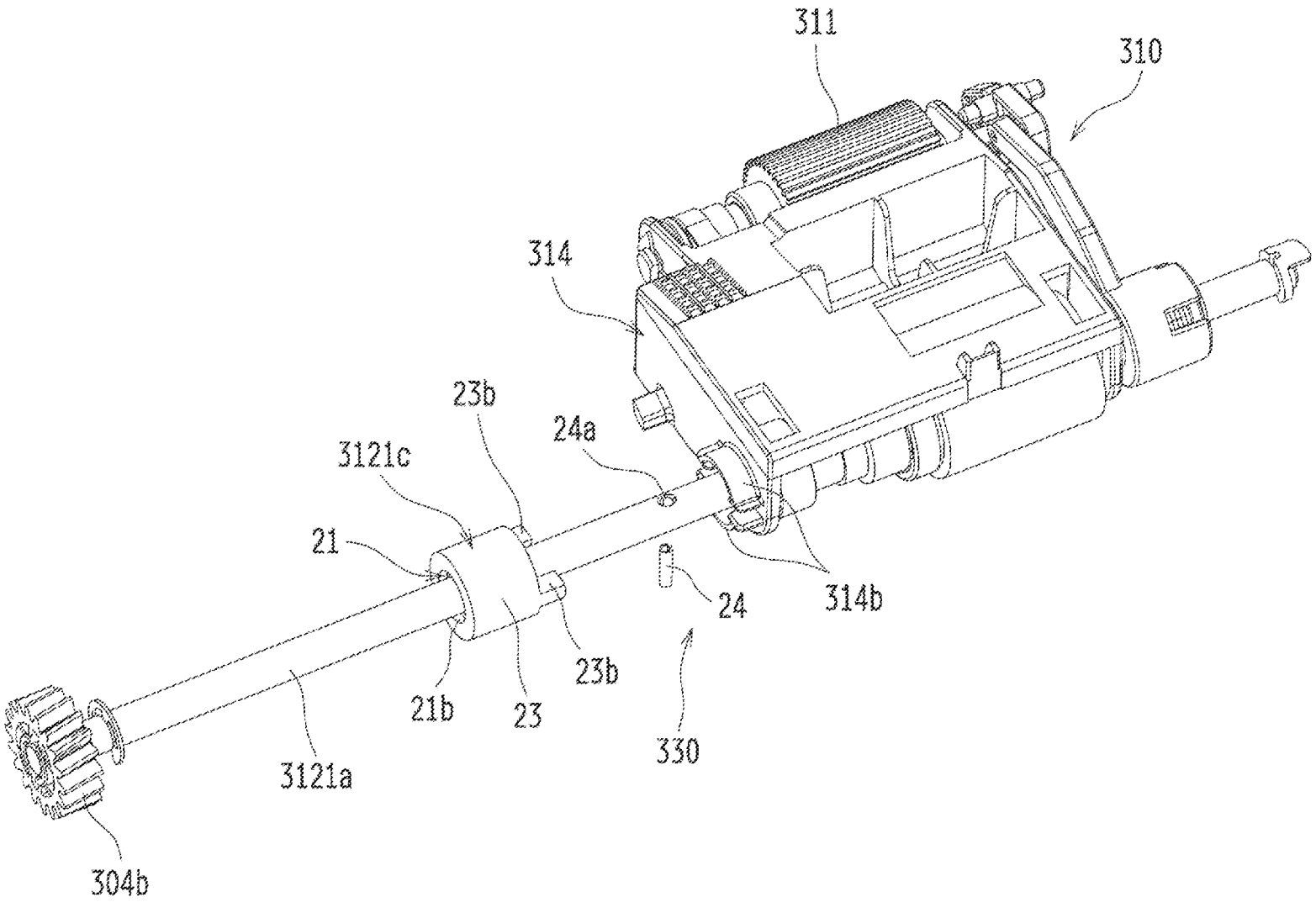
FIG. 13B is a perspective view illustrating a state where a shaft member is removed and the torque limiter is moved toward a first driven gear along a drive rotation shaft in the sheet supplier.
Figure 14A:
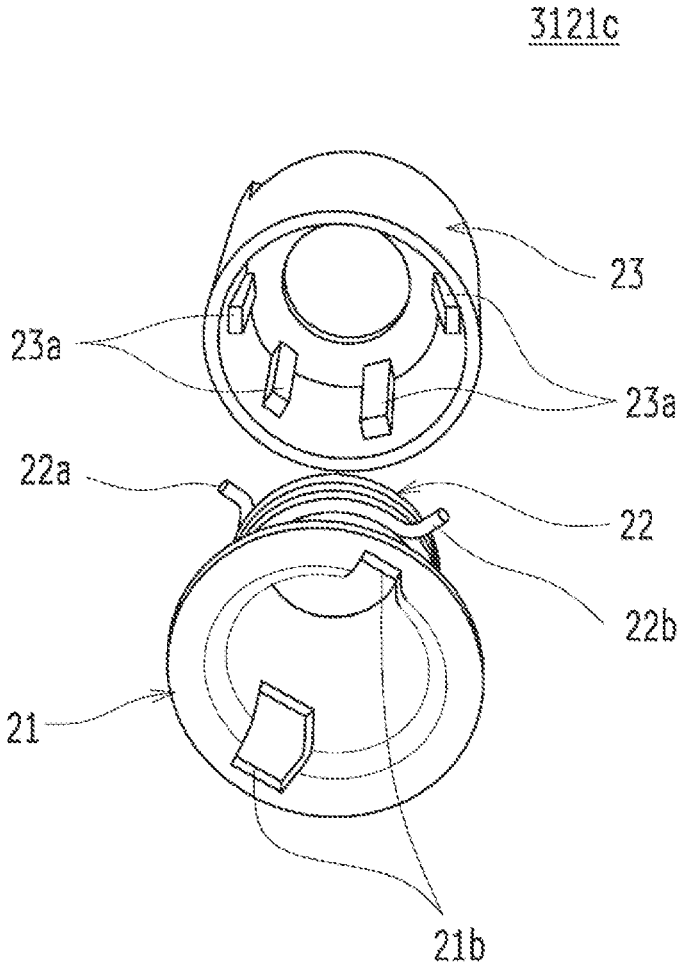
FIG. 14A is a perspective view of an inner ring onto which a coil spring is fitted and an outer ring in the torque limiter, as viewed from an inner ring side.
Figure 14B:
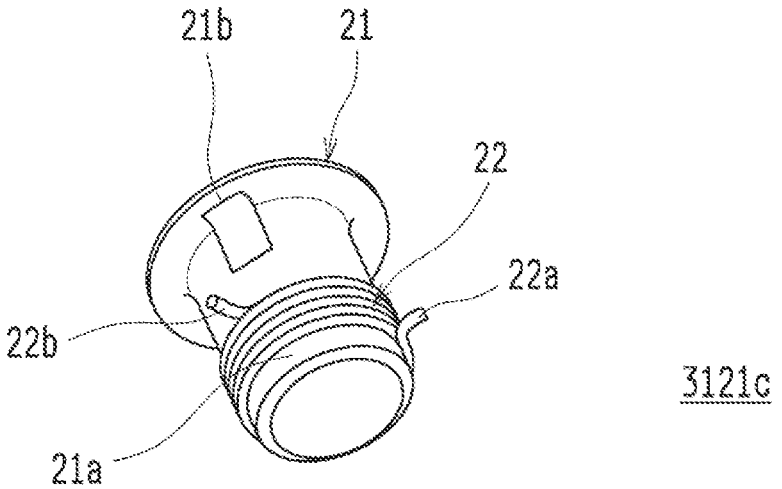
FIG. 14B is a perspective view of the inner ring onto which the coil spring is fitted and the outer ring in the torque limiter, as viewed from an outer ring side.
Figure 14B:
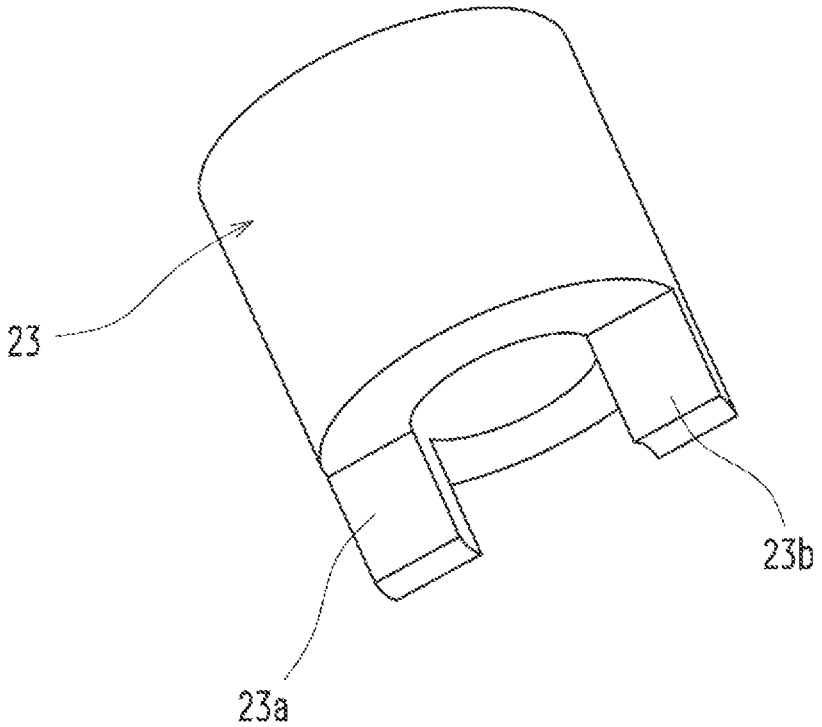
Figure 14C:
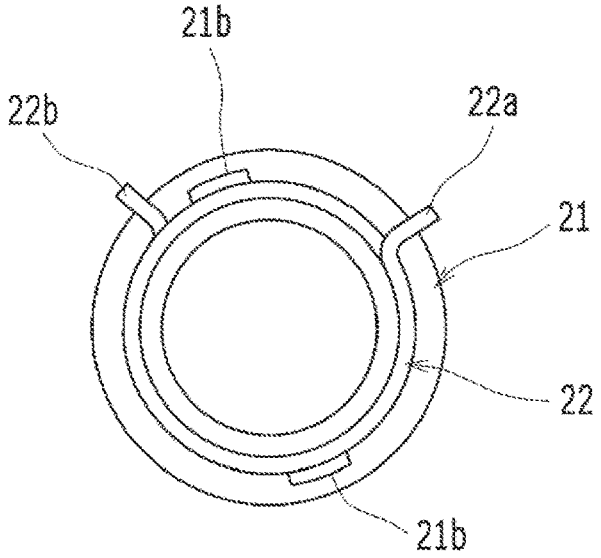
FIG. 14C is a rear view of the inner ring onto which the coil spring is fitted, as viewed from a coil spring side.
Figure 14D:
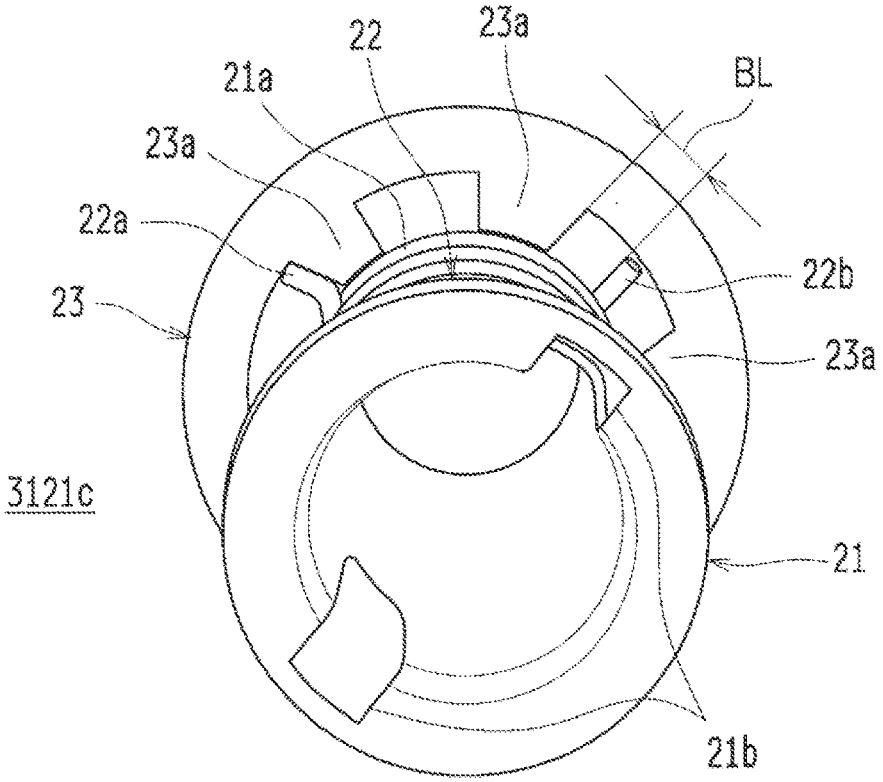
FIG. 14D is a perspective view illustrating how the inner ring is attached to the outer ring in the torque limiter.

FIG. 13A is a perspective view illustrating a portion of the torque limiter 3121*c* in the sheet supplier 310. FIG. 13B is a perspective view illustrating a state where a shaft member 24 is removed and the torque limiter 3121*c* is moved to the first driven gear 304*b* along the drive rotation shaft 3121*a* in the sheet supplier 310. FIG. 14A is a perspective view of an inner ring 21 onto which a coil spring 22 is fitted and an outer ring 23 in the torque limiter 3121*c*, as viewed from the inner ring 21 side. FIG. 14B is a perspective view of the inner ring 21 onto which the coil spring 22 is fitted and the outer ring 23 in the torque limiter 3121*c*, as viewed from the outer ring 23 side. FIG. 14C is a rear view of the inner ring 21 onto which the coil spring 22 is fitted, as viewed from the coil spring 22 side. FIG. 14D is a perspective view illustrating how the inner ring 21 is attached to the outer ring 23 in the torque limiter 3121*c*.

The torque limiter 3121*c* includes the inner ring 21, the coil spring 22, and the outer ring 23.

The inner ring 21 is a cylindrical member, into which the drive rotation shaft 3121*a* is inserted, and is fixed to the drive rotation shaft 3121*a*. Specifically, the inner ring 21 is provided with a locking device 21*b* (recess). The drive rotation shaft 3121*a* is provided with a through hole 24*a* penetrating in a direction orthogonal to the axial direction. The shaft member 24 is inserted into the through hole 24*a* in the drive rotation shaft 3121*a*. The coil spring 22 is fitted onto an outer peripheral surface 21*a* of the inner ring 21. The coil spring 22 does not move in the circumferential direction with respect to the inner ring 21 with a force less than a predetermined force, but slides in the circumferential direction with a force exceeding the predetermined force, and both ends 22*a* and 22*b* extend outward in the radial direction.

The outer ring 23 is a cylindrical member, into which the inner ring 21 onto which the coil spring 22 is fitted is inserted. The outer ring 23 is formed with a plurality of recesses 23*a* to 23*a* for locking both ends 22*a* and 22*b* of the coil spring 22 at predetermined intervals in the circumferential direction. Both ends 22*a* and 22*b* of the coil spring 22 are formed at predetermined intervals in the circumferential direction to have a backlash BL (see FIG. 14D) between the recesses 23*a* and 23*a* when the inner ring 21 onto which the coil spring 22 fitted is inserted into the outer ring 23. The outer ring 23 is fixed to the holding and coupling member 314. Specifically, extensions 23*b* and 23*b* are extended in the axial direction on the end surface of the outer ring 23 on a side of the holding and coupling member 314. The holding and coupling member 314 is provided with locking devices 314*b* and 314*b* (recesses) for locking the extensions 23*b* and 23*b* of the outer ring 23. Then, in the torque limiter 3121*c*, the shaft member 24 is inserted into the through hole 24*a* in the drive rotation shaft 3121*a* in a state where the extensions 23*b* and 23*b* in the outer ring 23 are locked to the locking devices 314*b* and 314*b* in the holding and coupling member 314, and thus is locked to the locking device 21*b* of the inner ring 21.

In the torque limiter 3121*c* described above, as illustrated in FIG. 14D, there is the backlash BL in the circumferential direction between both ends 22*a* and 22*b* of the coil spring 22 and the recesses 23*a* and 23*a* inside the outer ring 23, and the pickup roller 311 falls by its own weight by the amount of the backlash BL when the pickup roller 311 is lowered. Then, the rotational driving force of the driver device 316 has a momentum amplified resulting from its own weight falling by the amount of the backlash BL, which results in a loud collision noise generated when the pickup roller 311 contacts the sheet loading tray 301 or the document G on the sheet loading tray 301.

In this regard, in the sheet feeding device 300 according to the present embodiment, the controller 15 has the following control configuration.

Specifically, the controller 15 performs a drive suspend operation in which driving of the lifting/lowering mechanism 330 by the driver device 316 is suspended after a predetermined time during which the pickup roller 311 does not contact the sheet loading tray 301 or the document G on the sheet loading tray 301 elapses from a time point when the pickup roller 311 is released from being restricted at the lifted position by the holding mechanism 500 even if the pickup roller 311 falls by its own weight by the amount of backlash BL when the pickup roller 311 is lowered. Here, the time at a time point when the restriction by the holding mechanism 500 is released is, for example, the time of a predetermined number of first steps from a time point when the instruction signal is received from the operation processor 120 (see FIG. 12). The time after the predetermined time elapses from a time point when the restriction by the holding mechanism 500 is released is, for example, the time of a predetermined number of second steps from a time point when the instruction signal is received from the operation processor 120. The number of first steps and the number of second steps are stored in advance in the storage 15*b*. These times may be detected by a detector (sensor) that detects that the pickup roller 311 is released from being restricted at the lifted position by the holding mechanism 500.

Thus, in the present embodiment, the controller 15 performs the drive suspend operation in which the driving of the lifting/lowering mechanism 330 by the driver device 316 is suspended after the predetermined time elapses from a time point when the pickup roller 311 is released from being restricted at the lifted position by the holding mechanism 500, so that the momentum of the pickup roller 311 is suppressed before the pickup roller 311 contacts the sheet loading tray 301 or the document G on the sheet loading tray 301. As a result, it is possible to suppress the collision noise generated when the pickup roller 311 contacts the sheet loading tray 301 or the document G on the sheet loading tray 301. In addition, the drive suspend operation on the pickup roller 311 makes it possible to provide a simplified control configuration for lowering the pickup roller 311.

First Embodiment

In the present embodiment, the controller 15 resumes the suspended driving of the lifting/lowering mechanism 330 by the driver device 316 before the pickup roller 311 contacts the sheet loading tray 301 or the document G on the sheet loading tray 301.

This makes it possible to securely perform an operation of the lifting/lowering mechanism 330 after the suspend by the driver device 316.

Second Embodiment

In the present embodiment, the controller 15 performs the drive suspend operation when an initial operation for lifting and lowering the pickup roller 311 is performed.

This makes it possible to suppress the collision noise generated when the pickup roller 311 contacts the sheet loading tray 301 or the document G on the sheet loading tray 301 even if the initial operation is performed. For example, the controller 15 performs the drive suspend operation when the initial operation for lifting and lowering the pickup roller 311 is performed without picking up the document G.

Figure 15A:
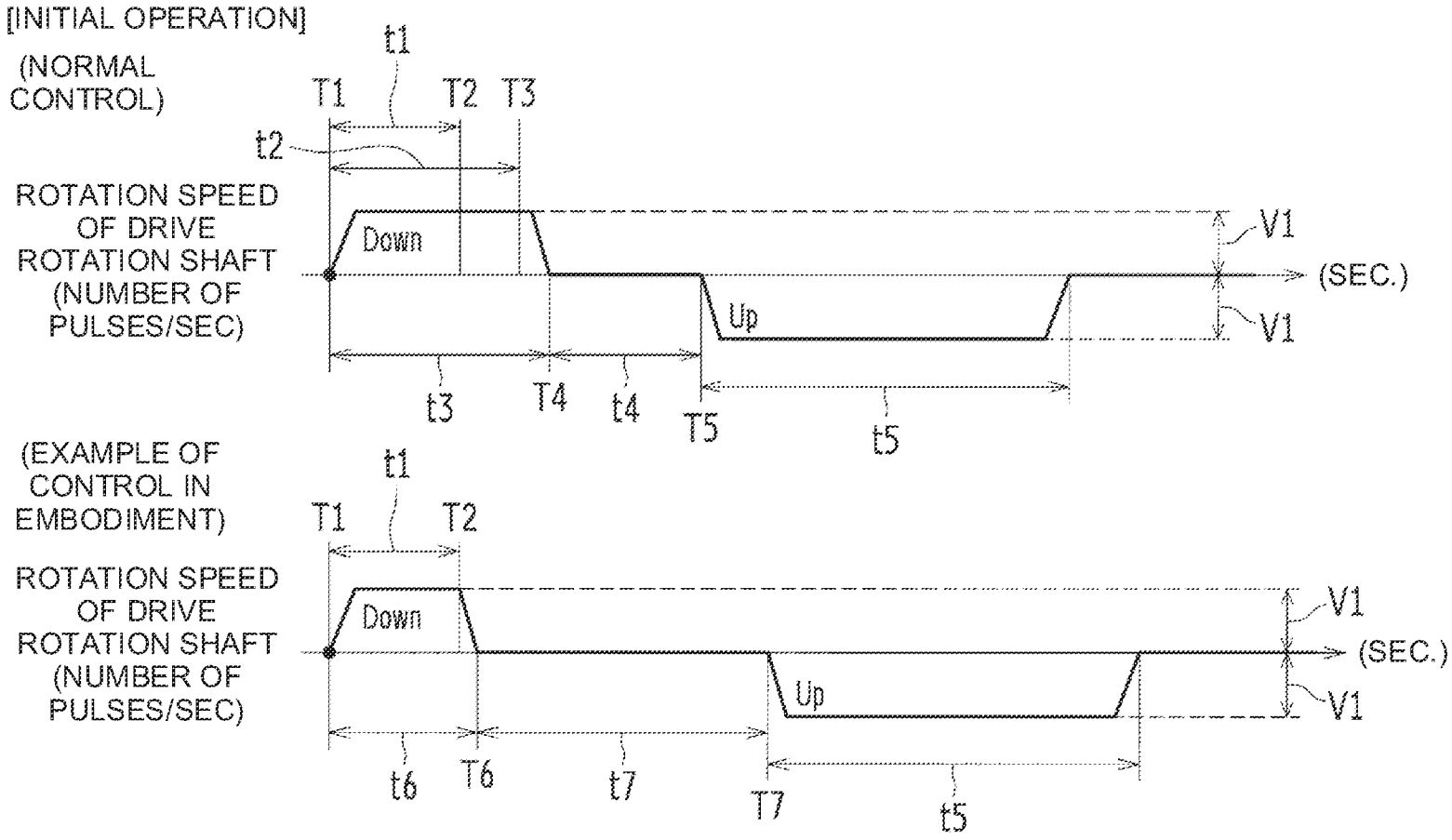
FIG. 15A is a timing chart illustrating examples of a normal control in which a drive suspend operation is not performed and a control in the present embodiment in which the drive suspend operation is performed when an initial operation is performed in the sheet feeding device.

FIG. 15A is a timing chart illustrating examples of a normal control in which the drive suspend operation is not performed when the initial operation is performed and a control in the present embodiment in which the drive suspend operation is performed in the sheet feeding device 300. In FIG. 15A, the horizontal axis represents a time and the vertical axis represents a rotation speed (number of pulses/second: PPS) of the drive rotation shaft 3121*a*. Here, the rated rotation speed of the driver device 316 is 4000 pps. The same applies to FIGS. 15B and 15C described below.

As illustrated in FIG. 15A, in the normal control in which the drive suspend operation is not performed when the initial operation is performed (see the upper figure of FIG. 15A), in a state where the pickup roller 311 is restricted at the lifted position by the holding mechanism 500 (see FIG. 11A), driving is started (the clutch for a supply roller 305 is turned on (at a first timing T1)) so that the drive rotation shaft 3121*a* rotates in the second pivot direction M2 at a predetermined first rotation speed V1 (1400 pps) (see FIG. 11B), and then the pickup roller 311 is released from being restricted at the lifted position by the holding mechanism 500 (at a second timing T2) after a predetermined first time t1 (40 ms) elapses (see FIG. 11C). Then, the pickup roller 311 contacts the sheet loading tray 301 or the document G on the sheet loading tray 301 after a predetermined second time t2 (60 ms) elapses (at a third timing T3) from a time point of the start of driving (a time point when the pickup roller 311 is lowered and the clutch for a supply roller 305 is turned on (T1)). After that, the clutch for a supply roller 305 is turned off so that the drive rotation shaft 3121*a* is suspended (at a fourth timing T4) after a predetermined third time t3 (75 ms) elapses from a time point of the start of driving (a time point when the clutch for a supply roller 305 is turned on (T1)). Therefore, in the normal control, the collision noise generated when the pickup roller 311 contacts the sheet loading tray 301 or the document G on the sheet loading tray 301 is loud. After that, the clutch for a supply roller 305 is turned on (at a fifth timing T5) after a predetermined fourth time t4 (50 ms) elapses from a time point when the clutch for a supply roller 305 is suspended (T4) so that the drive rotation shaft 3121*a* rotates in the first pivot direction M1 at the predetermined first rotation speed V1 (1400 pps) for a fifth time t5 (125 ms) (see FIG. 10A), and then the pickup roller 311 is lifted (see FIGS. 10B to 10D) and restricted at the lifted position (see FIG. 10E).

On the other hand, in an example of a control according to the present embodiment in which the drive suspend operation is performed when the initial operation is performed (see the lower figure of FIG. 15A), in a state where the pickup roller 311 is restricted at the lifted position by the holding mechanism 500 (see FIG. 11A), driving is started (the clutch for a supply roller 305 is turned on (at a first timing T1)) so that the drive rotation shaft 3121*a* rotates in the second pivot direction M2 at a predetermined first rotation speed V1 (1400 pps) (see FIG. 11B), and then, near (around) a predetermined first time t1 (40 ms), that is, near (around) the time when the pickup roller 311 is released from being restricted at the lifted position by the holding mechanism 500, the drive rotation shaft 3121*a* is suspended (at a sixth timing T6) after a predetermined sixth time t6 (50 ms) elapses from a time point of the start of driving (a time point when the clutch for a supply roller 305 is turned on (T1)). At this time, the pickup roller 311 is released from being restricted at the lifted position by the holding mechanism 500 (at a second timing T2) and the pickup roller 311 is lowered (see FIG. 11C), but the pickup roller 311 does not contact the sheet loading tray 301 or the document G on the sheet loading tray 301. Therefore, in the example of the control in the present embodiment, it is possible to suppress the collision noise generated when the pickup roller 311 contacts the sheet loading tray 301 or the document G on the sheet loading tray 301. After that, the clutch for a supply roller 305 is turned on (at a seventh timing T7) after a predetermined seventh time t7 (100 ms) elapses from a time point when the clutch for a supply roller 305 is suspended (T6) so that the drive rotation shaft 3121*a* rotates in the first pivot direction M1 at the predetermined first rotation speed V1 (1400 pps) for a fifth time t5 (125 ms) (see FIG. 10A), and then the pickup roller 311 is lifted (see FIGS. 10B to 10D) and restricted at the lifted position (see FIG. 10E).

In the present embodiment, in the initial operation of the controller 15, a driving time of the driver device 316 during lowering during which the pickup roller 311 is lowered (the sixth time t6: 50 ms) is shorter than a driving time of the driver device 316 during lifting during which the pickup roller 311 is lifted (the fifth time t5: 125 ms).

This makes it possible to suppress the momentum of the pickup roller 311 by an amount by which the driving time of the driver device 316 during lowering during which the pickup roller 311 is lowered is shorter than the driving time of the driver device 316 during lifting during which the pickup roller 311 is lifted, so that the collision noise generated when the pickup roller 311 contacts the sheet loading tray 301 or the document G on the sheet loading tray 301 is suppressed accordingly.

Third Embodiment

In the present embodiment, the controller 15 performs the drive suspend operation at the time of a sheet feed operation of picking up a document G and feeding the document G. The controller 15 resumes the once suspended driving of the lifting/lowering mechanism 330 by the driver device 316 before the pickup roller 311 contacts the sheet loading tray 301 or the document G on the sheet loading tray 301.

This makes it possible to suppress the collision noise generated when the pickup roller 311 contacts the sheet loading tray 301 or the document G on the sheet loading tray 301 even if the sheet feed operation is performed.

Figure 15B:
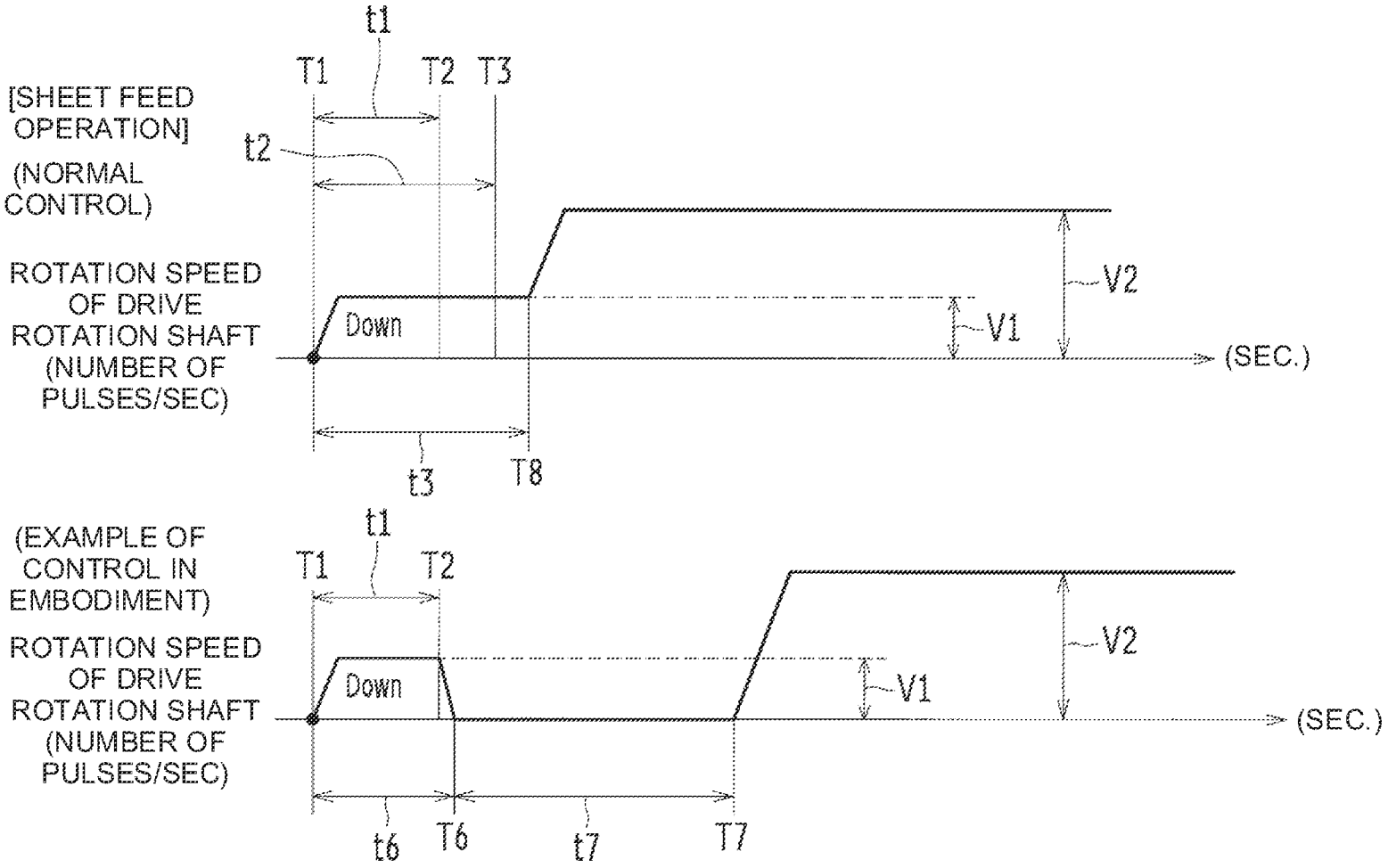
FIG. 15B is a timing chart illustrating examples of a normal control in which a drive suspend operation is not performed and a control in the present embodiment in which the drive suspend operation is performed when a sheet feed operation is performed in the sheet feeding device.

FIG. 15B is a timing chart illustrating examples of a normal control in which the drive suspend operation is not performed when the sheet feed operation is performed and a control in the present embodiment in which the drive suspend operation is performed in the sheet feeding device 300.

As illustrated in FIG. 15B, in the normal control in which the drive suspend operation is not performed when the sheet feed operation is performed (see the upper figure of FIG. 15B), in a state where the pickup roller 311 is restricted at the lifted position by the holding mechanism 500 (see FIG. 11A), driving is started (the clutch for a supply roller 305 is turned on (at a first timing T1)) so that the drive rotation shaft 3121*a* rotates in the second pivot direction M2 at a predetermined first rotation speed V1 (1400 pps) (see FIG. 11B), and then the pickup roller 311 is released from being restricted at the lifted position by the holding mechanism 500 (at a second timing T2) after a predetermined first time t1 (40 ms) elapses (see FIG. 11C). Then, the pickup roller 311 contacts the sheet loading tray 301 or the document G on the sheet loading tray 301 after a predetermined second time t2 (60 ms) elapses (at a third timing T3) since the lowering of pickup roller 311, that is, from a time point of the start of driving time (a time point when the clutch for a supply roller 305 is turned on (T1)). Therefore, in the normal control, the collision noise generated when the pickup roller 311 contacts the sheet loading tray 301 or the document G on the sheet loading tray 301 is loud. After that, the drive rotation shaft 3121*a* rotates (at an eighth timing T8) in the second pivot direction M2 at a predetermined second rotation speed V2 (4000 pps) higher than the first rotation speed V1, after a predetermined third time t3 (75 ms) elapses from a time point of the start of driving (a time point when the clutch for a supply roller 305 is turned on (T1)).

On the other hand, in an example of a control according to the present embodiment in which the drive suspend operation is performed when the sheet feed operation is performed (see the lower figure of FIG. 15B), in a state where the pickup roller 311 is restricted at the lifted position by the holding mechanism 500 (see FIG. 11A), driving of the clutch for a supply roller 305 is started (turned on (at a first timing T1)) so that the drive rotation shaft 3121*a* rotates in the second pivot direction M2 at a predetermined first rotation speed V1 (1400 pps) (see FIG. 11B), and then, near (around) a predetermined first time t1 (40 ms), that is, near (around) the time when the pickup roller 311 is released from being restricted at the lifted position by the holding mechanism 500, the drive rotation shaft 3121*a* is suspended (at a sixth timing T6) after a predetermined sixth time t6 (50 ms) elapses from a time point of the start of driving (a time point when the clutch for a supply roller 305 is turned on (T1)). At this time, the pickup roller 311 is released from being restricted at the lifted position by the holding mechanism 500 (at a second timing T2) and the pickup roller 311 is lowered (see FIG. 11C), but the pickup roller 311 does not contact the sheet loading tray 301 or the document G on the sheet loading tray 301. Therefore, in the example of the control in the present embodiment, it is possible to suppress the collision noise generated when the pickup roller 311 contacts the sheet loading tray 301 or the document G on the sheet loading tray 301. After that, the clutch for a supply roller 305 is turned on (at a seventh timing T7) after a predetermined seventh time t7 (100 ms) elapses from a time point when the clutch for a supply roller 305 suspends (T6) so that the drive rotation shaft 3121*a* rotates in the second pivot direction M2 at the second rotation speed V2 (4000 pps) again.

In the present embodiment, in the sheet feed operation of the controller 15, a driving speed (first rotation speed V1) of the driver device 316 during release of restriction for releasing the pickup roller 311 from being restricted by the holding mechanism 500 is smaller than a speed of the resumed driving (second rotation speed V2) of the driver device 316.

This makes it possible to suppress the momentum of the pickup roller 311 by an amount by which the driving speed (first rotation speed V1) of the driver device 316 during release of restriction for releasing the pickup roller 311 from being restricted by the holding mechanism 500 is smaller than the speed of the resumed driving (second rotation speed V2) of the driver device 316, so that the collision noise generated when the pickup roller 311 contacts the sheet loading tray 301 or the document G on the sheet loading tray 301 is suppressed accordingly.

Fourth Embodiment

Figure 15C:
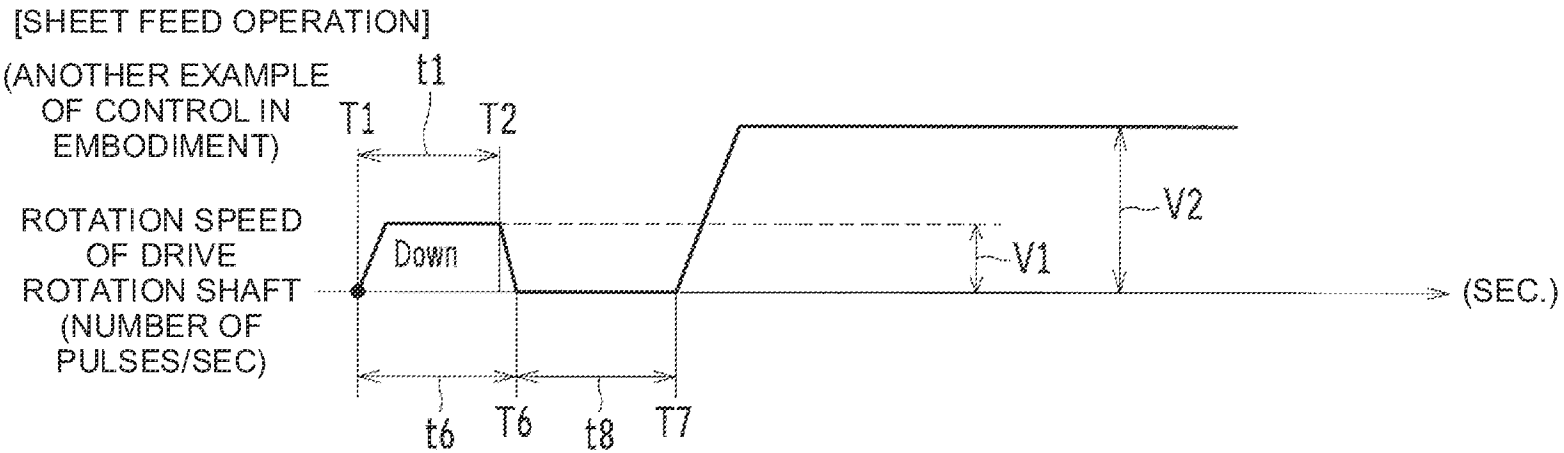
FIG. 15C is a timing chart illustrating another example of a control in the present embodiment in which the drive suspend operation is performed when the sheet feed operation is performed in the sheet feeding device.

FIG. 15C is a timing chart illustrating another example of a control in the present embodiment in which the drive suspend operation is performed when the sheet feed operation is performed in the sheet feeding device 300.

Another example of the control according to the present embodiment in which the drive suspend operation is performed when the sheet feed operation illustrated in FIG. 15C is performed is different from the example of the control according to the present embodiment in which the drive suspend operation is performed when the sheet feed operation illustrated in FIG. 15B is performed in that an eighth time t8 (50 ms) for which the drive rotation shaft 3121*a* rotates again from a time point when the clutch for a supply roller 305 suspends (T6) is set to be smaller than the seventh time t7 (100 ms). For example, the total time of the sixth time t6 and the eighth time t8 may be equal to or substantially equal to the third time t3 from a time point of the start of driving to a time of switching the drive rotation shaft 3121*a* from the first rotation speed V1 to the second rotation speed V2 in the normal control in which the drive suspend operation is not performed.

This makes it possible to shorten the conveyance time from a time point of the start of driving for the first document G (a time point when the clutch for a supply roller 305 is turned on (T1)).

OTHER EMBODIMENTS

In the first to fourth embodiments described above, a sheet is the document G and the document G loaded on the sheet loading tray 301 is conveyed. However, the sheet may be the sheet P and the sheet P loaded on the paper feed tray 81 or the manual paper feed tray 82 may be conveyed.

The present invention is not limited to the embodiments described above, and is implemented in various other forms. Thus, the embodiments are merely examples in all respects and should not be interpreted in a limiting manner. The scope of the present invention is defined by the claims, and is not restricted by the description of the specification in any way. All modifications and changes belonging to a scope equivalent to the claims are included within the scope of the present invention.

What is claimed is:

1. A sheet feeding device comprising:

a pickup roller that picks up a sheet loaded on a sheet loading tray;

a lifting/lowering mechanism that lifts and lowers the pickup roller; and a driver motor that drives the lifting/lowering mechanism, wherein the pickup roller is lowered from a lifted position to pick up the sheet on the sheet loading tray, wherein the lifting/lowering mechanism includes a holding mechanism that releasably restricts the pickup roller from being lowered from the lifted position, the driver motor drives the lifting/lowering mechanism so that the pickup roller is lowered from the lifted position, and a drive suspend operation is performed in which driving of the lifting/lowering mechanism by the driver motor is suspended after a predetermined time period, wherein during the drive suspend operation, the pickup roller does not contact the sheet loading tray or the sheet on the sheet loading tray, and the predetermined time period begins from a time point when the pickup roller is released from being restricted by the holding mechanism at the lifted position, the lifting/lowering mechanism includes:

a drive rotation shaft rotatably supported by a sheet feeding device main body around a rotation axis, the drive rotation shaft being rotationally driven by the driver motor;

a holding member swingably supported by the drive rotation shaft via a torque limiter, the holding member rotatably holding a rotation shaft of the pickup roller around the rotation axis; and a drive transmission mechanism that transmits a rotational driving force from the drive rotation shaft to the pickup roller, wherein:

the pickup roller is lifted and lowered as the driver motor rotates the drive rotation shaft, the holding mechanism includes a first pivoting member provided on the drive rotation shaft and a second pivoting member provided in a member on a side of the sheet feeding device main body such that the second pivoting member rotates around a pivoting axis along the drive rotation shaft, the first pivoting member is provided with a first engagement, the second pivoting member is provided with a second engagement and a locking device when the second engagement engages with the first engagement, the first pivoting member is pivoted with the drive rotation shaft so that the locking device locks the pickup roller in the lifted position, the holding member rotatably couples the rotation shaft of the pickup roller and the drive rotation shaft, and the drive transmission mechanism includes a driving member provided on the drive rotation shaft, a driven member provided on the rotation shaft of the pickup roller, and a drive transmission member that transmits the rotational driving force from the driving member to the driven member.

2. The sheet feeding device according to claim 1, wherein after the drive suspend operation, the driver motor resumes driving the lifting/lowering mechanism before the pickup roller contacts the sheet loading tray or the sheet on the sheet loading tray.

3. The sheet feeding device according to claim 1, wherein the drive suspend operation is performed when an initial operation for lifting and lowering the pickup roller is performed.

4. The sheet feeding device according to claim 3, wherein in the initial operation, a driving time of the driver motor lowering the pickup roller is shorter than a driving time of the driver motor lifting the pickup roller.

5. The sheet feeding device according to claim 1, wherein the drive suspend operation is performed during a sheet feed operation of picking up the sheet and feeding the sheet.

6. The sheet feeding device according to claim 5, wherein after the drive suspend operation, the driver motor resumes driving the lifting/lowering mechanism before the pickup roller contacts the sheet loading tray or the sheet on the sheet loading tray, and in the sheet feed operation, a driving speed of the driver motor during releasing of the pickup roller from being restricted by the holding mechanism is lower than a speed of the driver motor after resuming driving of the lifting/lowering mechanism.

7. An image forming apparatus comprising the sheet feeding device according to claim 1.

* * * * *